US009941580B2

(12) United States Patent
Hsu et al.

(10) Patent No.: US 9,941,580 B2
(45) Date of Patent: Apr. 10, 2018

(54) ANTENNA AND COMPLEX ANTENNA

(71) Applicant: Wistron NeWeb Corporation, Hsinchu (TW)

(72) Inventors: Chieh-Sheng Hsu, Hsinchu (TW); Cheng-Geng Jan, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 138 days.

(21) Appl. No.: 15/073,668

(22) Filed: Mar. 18, 2016

(65) Prior Publication Data

US 2016/0285170 A1 Sep. 29, 2016

(30) Foreign Application Priority Data

Mar. 25, 2015 (TW) ..... 104109571 A
Feb. 5, 2016 (TW) ..... 105103991 A

(51) Int. Cl.
*H01Q 1/36* (2006.01)
*H01Q 1/42* (2006.01)
*H01Q 19/17* (2006.01)
*H01Q 19/185* (2006.01)

(52) U.S. Cl.
CPC ..... *H01Q 1/36* (2013.01); *H01Q 1/42* (2013.01); *H01Q 19/17* (2013.01); *H01Q 19/185* (2013.01)

(58) Field of Classification Search
CPC H01Q 1/36; H01Q 1/42; H01Q 19/17; H01Q 19/185
USPC ..... 343/840
See application file for complete search history.

(56) References Cited

U.S. PATENT DOCUMENTS 7,327,315 B2 * 2/2008 Starkie ..... H01Q 5/00 343/700 MS
7,839,351 B2 * 11/2010 Schadler ..... H01Q 1/246 343/742
8,717,250 B2 * 5/2014 Nilsson ..... H01Q 9/28 343/893
9,496,615 B2 * 11/2016 Hsu ..... H01Q 5/378
2010/0085264 A1 4/2010 Du
2010/0149060 A1 * 6/2010 Lin ..... H01Q 9/0407 343/767
2012/0182195 A1 * 7/2012 Monte ..... H01Q 1/288 343/779

FOREIGN PATENT DOCUMENTS

TW 201236265 A1 9/2012

* cited by examiner

*Primary Examiner* — Huedung Mancusco
(74) *Attorney, Agent, or Firm* — Winston Hsu

(57) ABSTRACT

An antenna for receiving and transmitting radio signals, including a reflective unit, comprising a central reflective element; and a plurality of peripheral reflective elements, enclosing the central reflective element to form a frustum structure; and at least one radiation unit, disposed above the central reflective element; where the reflective unit is electrically isolated from the at least one radiation unit.

18 Claims, 27 Drawing Sheets

ANTENNA AND COMPLEX ANTENNA

BACKGROUND OF THE INVENTION

1. Field of the Invention

The present invention relates to an antenna and a complex antenna, and more particularly, to an antenna and a complex antenna having smaller size to be disposed in a cylindrical radome and allowing both multiband and low-frequency operations.

2. Description of the Prior Art

Electronic products with wireless communication functionalities utilize antennas to emit and receive radio waves, to transmit or exchange radio signals, so as to access a wireless communication network. With the advance of wireless communication technology, an electronic product may be configured with an increasing number of antennas. Alternatively, a complex antenna equipped with a plurality of antennas may be used in an electronic product to transmit or receive radio signals. A complex antenna turns on its antenna (s) according to the direction of signal transmission, thereby effectively enhancing spectral efficiency and transmission rate for the wireless communication system, as well as improving communication quality. In such a situation, each of the antennas constituting a complex antenna is preferably a directional antenna, which point energy toward a specific direction for concentration within a targeted area.

An ideal antenna should maximize its bandwidth within a permitted range, while minimizing physical dimensions to accommodate the trend for smaller-sized electronic products. Technically, a complex antenna is disposed in a cylindrical radome, which limits the sizes of the antennas constituting the complex antenna. However, the long term evolution (LTE) wireless communication system includes 44 bands which cover from 698 MHz to 3800 MHz. Because of the bands being separated and disordered, a mobile system operator may use multiple bands simultaneously in the same country or area. In the LTE wireless communication system, band 13 (covering from 746 MHz to 787 MHz) requires lower frequencies, and hence a complex antenna operated in band 13 would occupy larger space. Without adequate size, the complex antenna cannot meet the requirements of multiband or wideband transmission. What's worse, interference between antennas might occur to threaten normal operations of the antennas.

Obviously, providing an antenna of small size that allows multiband and low-frequency operations is a significant objective in the field.

SUMMARY OF THE INVENTION

Therefore, the present invention primarily provides an antenna and a complex antenna having small size and allowing both multiband and low-frequency operations.

An embodiment of the present invention discloses an antenna for receiving and transmitting radio signals, comprising a reflective unit, comprising a central reflective element; and a plurality of peripheral reflective elements, enclosing the central reflective element to form a frustum structure; and at least one radiation unit, disposed above the central reflective element; wherein the reflective unit is electrically isolated from the at least one radiation unit.

An embodiment of the present invention further discloses a complex antenna for receiving and transmitting radio signals, comprising a plurality of antennas, each of the plurality of antennas comprising a reflective unit, comprising a central reflective element; and a plurality of peripheral reflective elements, enclosing the central reflective element to form a frustum structure; and at least one radiation unit, disposed above the central reflective element; wherein the reflective unit is electrically isolated from the at least one radiation unit.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
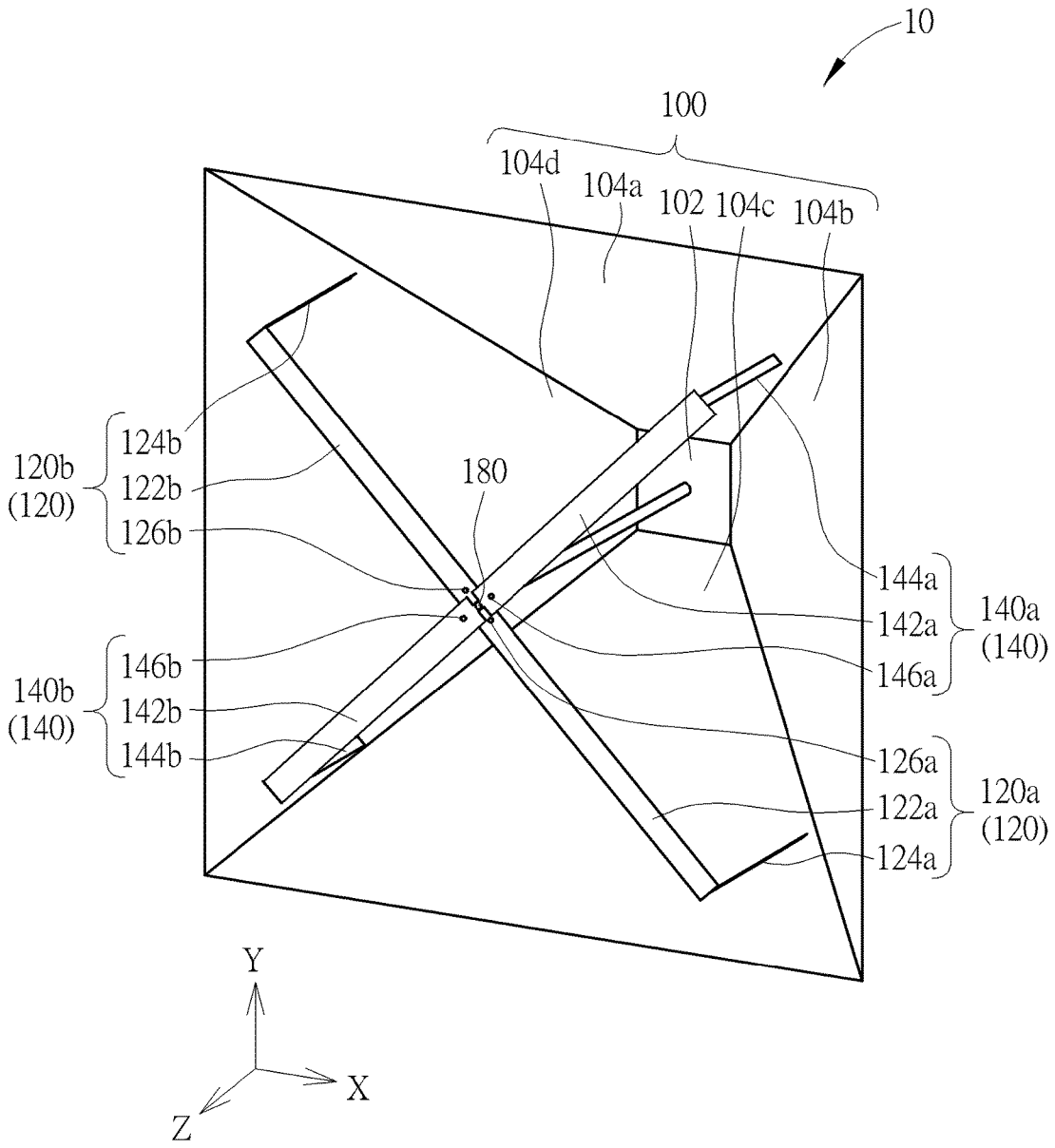
FIG. 1A is a schematic diagram illustrating an antenna according to an embodiment of the present invention.
Figure 1B:
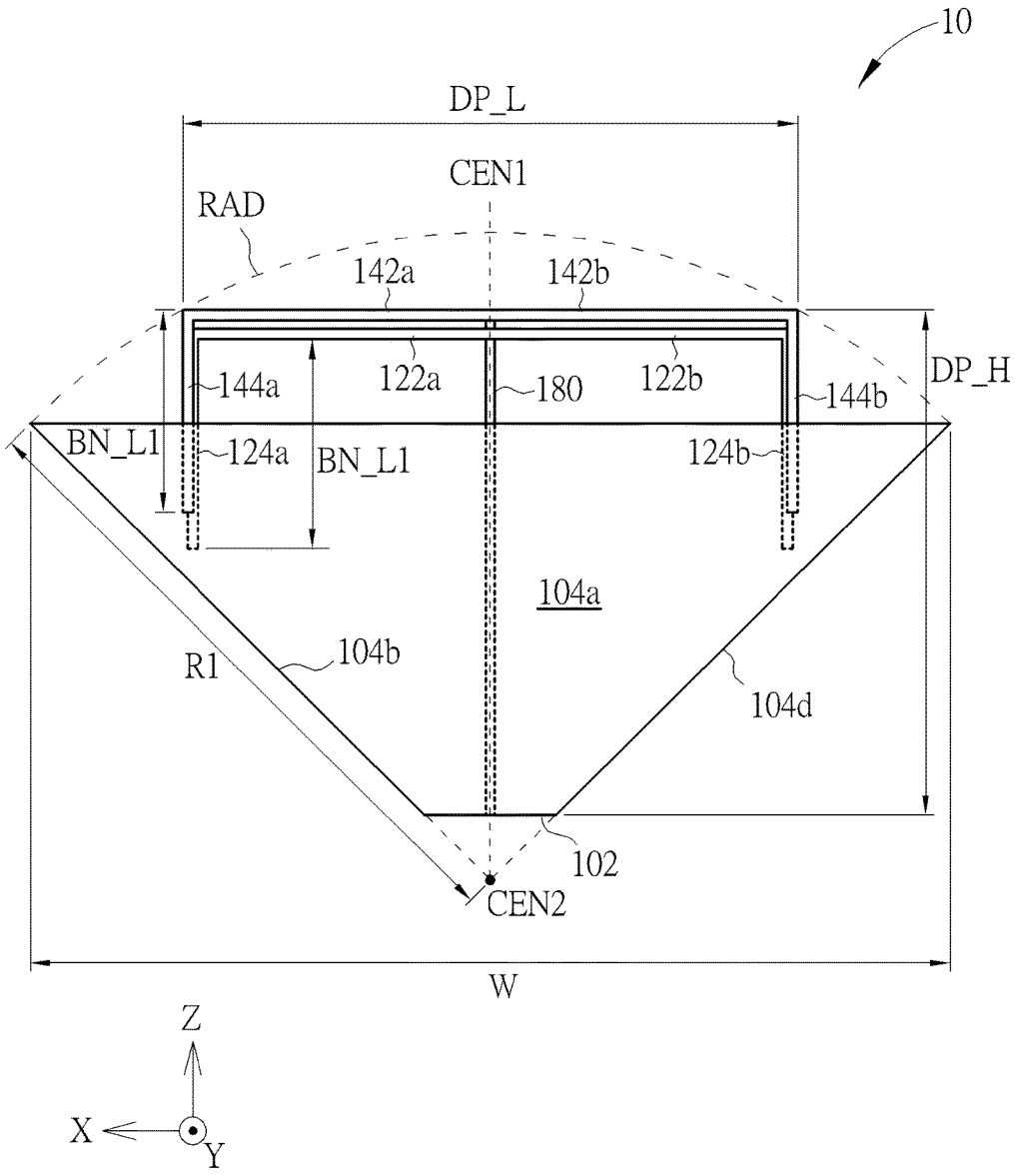
FIG. 1B is a lateral-view schematic diagram illustrating the antenna shown in FIG. 1A.

Please refer to FIG. 1A and FIG. 1B. FIG. 1A is a schematic diagram illustrating an antenna 10 according to an embodiment of the present invention. FIG. 1B is a lateral-view schematic diagram illustrating the antenna 10. The antenna 10 includes a reflective unit 100, radiation units 120, 140 and a supporting element 180. The reflective unit 100 includes a central reflective element 102 and peripheral reflective elements 104*a* to 104*d* to reflect electromagnetic waves, thereby increasing gain of the antenna 10. Each of the peripheral reflective elements 104*a* to 104*d* has a shape substantially conforming to an isosceles trapezoid with symmetry. Taken together, the peripheral reflective elements 104*a* to 104*d* enclose the central reflective element 102 symmetrically to form a frustum structure. The radiation units 120 and 140 are disposed above the central reflective element 102 with the supporting element 180, and the radiation units 120 and 140 are electrically isolated from the reflective unit 100—meaning that the radiation unit 120 or 140 is not electrically connected to or contacting the reflective unit 100. The radiation unit 120 includes conductor plates 120*a* and 120*b* with symmetry to form a dipole antenna of 135-degree slant polarized. The conductor plates 120*a* and 120*b* include main sections 122*a*, 122*b*, first arm sections 124*a*, 124*b* and feed-in points 126*a*, 126*b*, respectively. The feed-in points 126*a* and 126*b*, which are configured for feeding the antenna 10 with a transmission line (not shown) connected to the feed-in points 126*a* and 126*b*, are disposed on and within the main sections 122*a* and 122*b*, respectively. Ends of the first arm sections 124*a* and 124*b* are connected to ends of the main sections 122*a* and 122*b* respectively. However, the first arm section 124*a* is not coplanar to the main section 122*a* but extending toward the reflective unit 100; the first arm section 124*b* is not coplanar to the main section 122*b* but extending toward the reflective unit 100. Similarly, the radiation unit 140 includes the conductor plates 140*a* and 140*b* with symmetry to form a dipole antenna of 45-degree slant polarized. The conductor plates 140*a* and 140*b* include main sections 142*a*, 142*b*, first arm sections 144*a*, 144*b* and feed-in points 146*a*, 146*b*, respectively. The feed-in points 146*a* and 146*b*, which are configured for feeding the antenna 10 with another transmission line (not shown) connected to the feed-in points 146*a* and 146*b*, are disposed on and within the main sections 142*a* and 142*b*, respectively. Ends of the first arm sections 144*a* and 144*b* are connected to ends of the main sections 142*a* and 142*b* respectively. Nevertheless, the first arm section 144*a* is not coplanar to the main section 142*a* but extending toward the reflective unit 100; the first arm section 144*b* is not coplanar to the main section 142*b* but extending toward the reflective unit 100.

In short, when the total length DP_L of the main sections 122*a* and 122*b* and the total length DP_L of the main sections 142*a* and 142*b* are less than half of an operating wavelength, an effective length of the radiation unit 120 and an effective length of the radiation unit 140 would be increased to improve return loss (i.e., S11 parameter value) by means of the first arm sections 124*a*, 124*b*, 144*a* and 144*b* respectively. This may minimize a size of the antenna 10, meet transmission requirements of low frequency, and improve resonance effects of the antenna 10.

To enhance polarization isolation (i.e., common polarization to cross polarization parameters), the antenna 10 should be symmetrical. Therefore, as shown in FIG. 1B, the reflective unit 100 and the main sections 122*a*, 122*b*, 142*a*, 142*b* are symmetric with respect to a centerline CENT of the reflective unit 100 extending along an axis Z respectively. If the radiation unit 140 is separated from the central reflective element 102 by a height DP_H, the radiation unit 120 is separated from the central reflective element 102 by the height DP_H substantially. Nevertheless, there may be a height difference between the radiation unit 140 and the radiation unit 120 to avoid a short circuit, and a value of the height difference is substantially less than one tenth of a height DP_H. Because of symmetry, the total length between the main sections 122*a* and 122*b* and between the main sections 142*a* and 142*b* will be the total length DP_L; the first arm sections 124*a*, 124*b*, 144*a* and 144*b* may have a length BN_L1 respectively. Moreover, the antenna 10 may be disposed in a cylindrical radome RAD, which may have a radius R1 less than one quarter of the operating wavelength. A centerline CEN2 of the cylindrical radome RAD extending along an axis Y is determined after the peripheral reflective elements 104*b* and 104*d* are extended to intersect. In other words, because the antenna 10 is restricted by the radius R1, the height DP_H between the radiation unit 140 and the central reflective element 102 of the antenna 10 is less than one quarter of the operating wavelength, and the total length DP_L, of the main sections 142*a* and 142*b* is less than half of the operating wavelength. As the height DP_H increases, the total length DP_L must be reduced; when the total length DP_L becomes longer, the height DP_H must be shorten. In such a situation, to improve the return loss, the height DP_H is adjusted to a proper value first, and then the first arm sections 124*a*, 124*b*, 144*a* and 144*b* are utilized to increase the effective lengths of the radiation units 120 and 140.

Figure 2A:
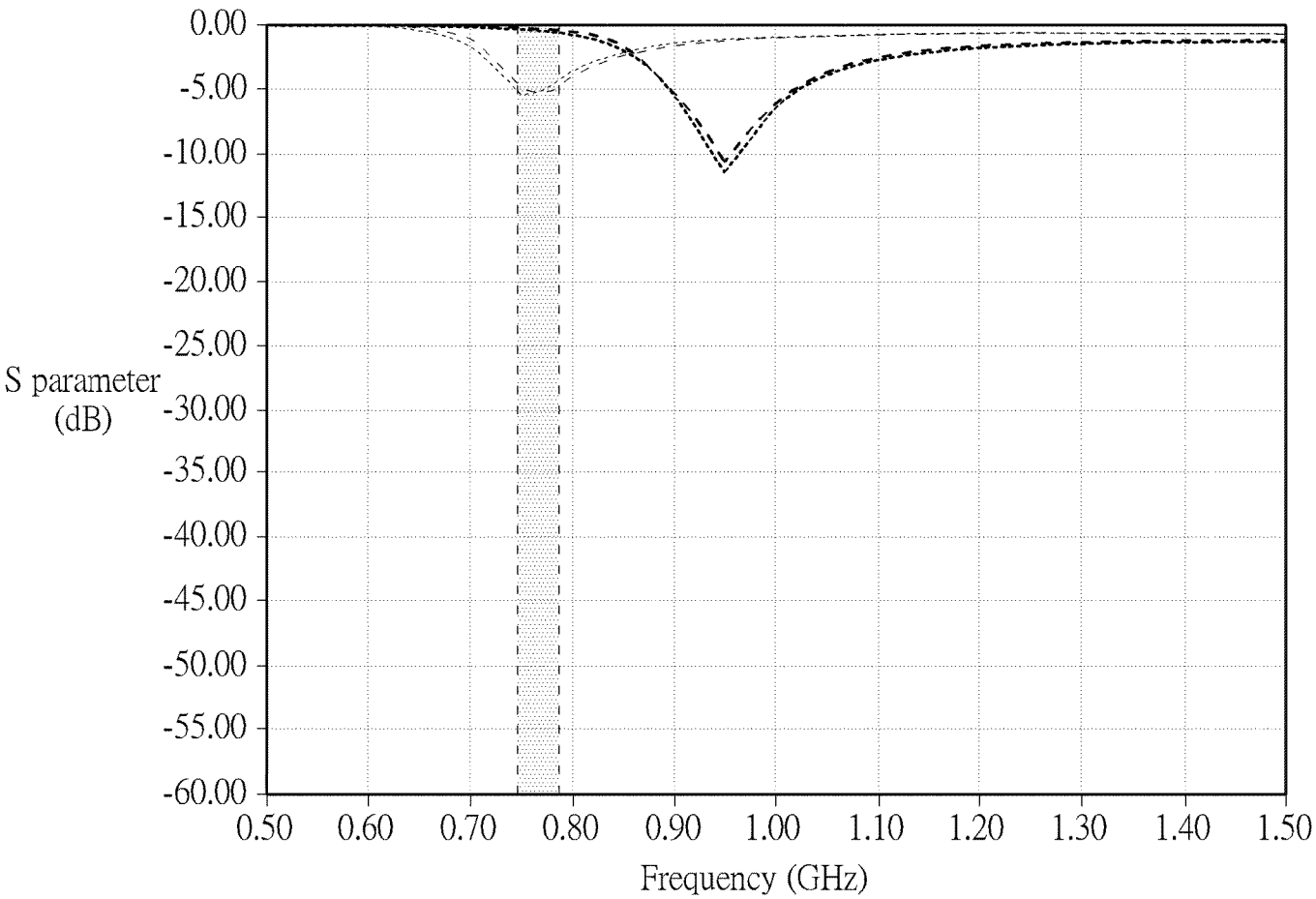
FIGS. 2A to 2C are schematic diagrams illustrating antenna resonance simulation results of the antenna shown in FIG. 1A with the height set to 75 mm, 82 mm and 86 mm, respectively.
Figure 2B:
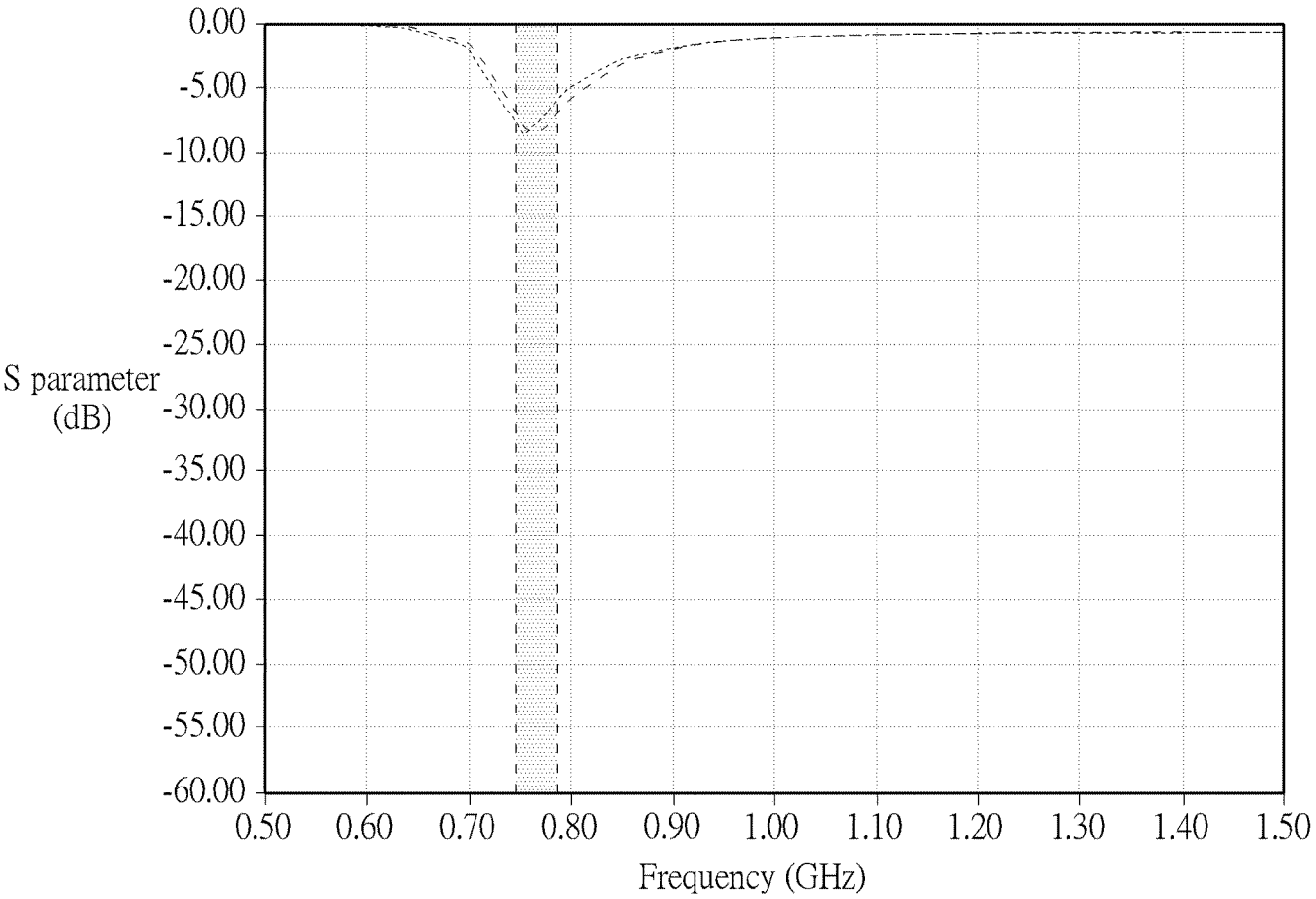
Figure 2C:
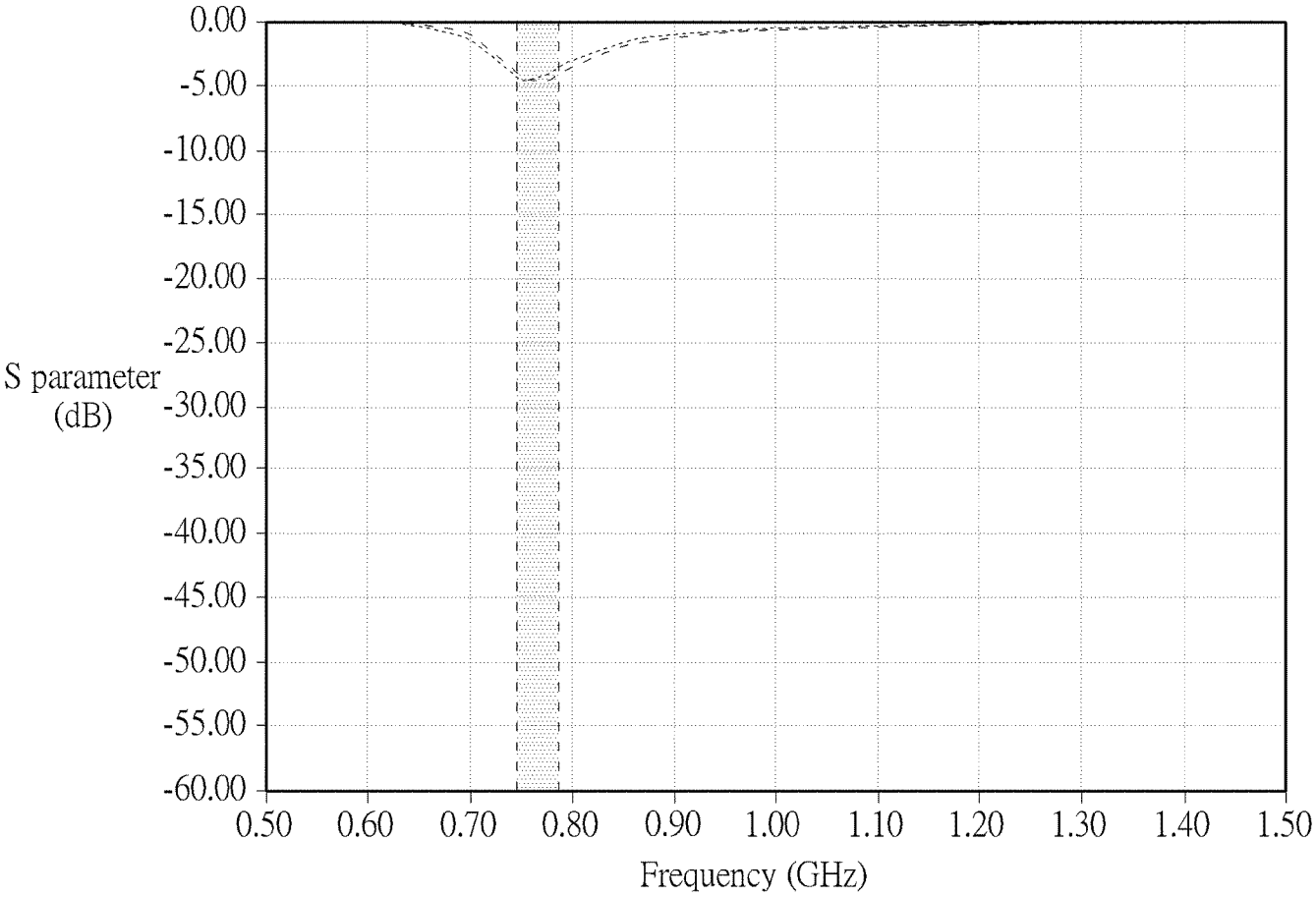

For example, please refer to Table 1 and FIGS. 2A to 2C. FIGS. 2A to 2C are schematic diagrams illustrating antenna resonance simulation results of the antenna 10 with the height DP_H set to 75 mm, 82 mm and 86 mm, respectively. Antenna resonance simulation results of a control group without the first arm sections 124*a*, 124*b*, 144*a* and 144*b* are also shown in FIG. 2A to be compared against. Antenna resonance simulation results of the radiation unit 120 of the antenna 10 and a radiation unit of an antenna of the control group are presented by a thin long dashed line and a thick long dashed line, respectively; antenna resonance simulation results of the radiation unit 140 of the antenna 10 and another radiation unit of the antenna of the control group are presented by a thin short dashed line and a thick short dashed line, respectively. Because antenna isolation simulation results are less than −60 dB, they are not illustrated in FIGS. 2A to 2C. Table 1 lists dimensions and maximum return loss of the antenna 10 shown in FIGS. 2A to 2C and the antenna of the control group. In Table 1, the radius R1 is set to 99 mm, and a base length W of the peripheral reflective elements 104*a* to 104*d* of the antenna 10 is set to 140 mm. Moreover, the radiation unit of the antenna of the control group also has the total length DP_L and is separated from a central reflective element of the antenna of the control group by the height DP_H. According to Table 1 and FIGS.

2A to 2C, the return loss of the antenna 10 may be improved to −6.97 dB when the first arm sections 124*a*, 124*b*, 144*a* and 144*b* are disposed.

TABLE 1

| corresponding FIGS. | the height DP_H | the total length DP_L | the maximum return loss (the antenna of the control group) | the length BN_L1 | the maximum return loss (the antenna 10) |
|---|---|---|---|---|---|
| FIG. 2A | 75 mm | 135 mm | −0.18 dB | 25.0 mm | −4.66 dB |
| | 78 mm | 113 mm | | 37.2 mm | −6.12 dB |
| | 80 mm | 99 mm | | 44.8 mm | −6.74 dB |
| | 81 mm | 91 mm | | 49.1 mm | −6.91 dB |
| FIG. 2B | 82 mm | 85 mm | | 52.3 mm | −6.97 dB |
| | 83 mm | 79 mm | | 55.6 mm | −6.87 dB |
| | 84 mm | 75 mm | −0.01 dB | 57.9 mm | −6.75 dB |
| FIG. 2C | 86 mm | 45 mm | | 73.8 mm | −4.03 dB |

Figure 3:
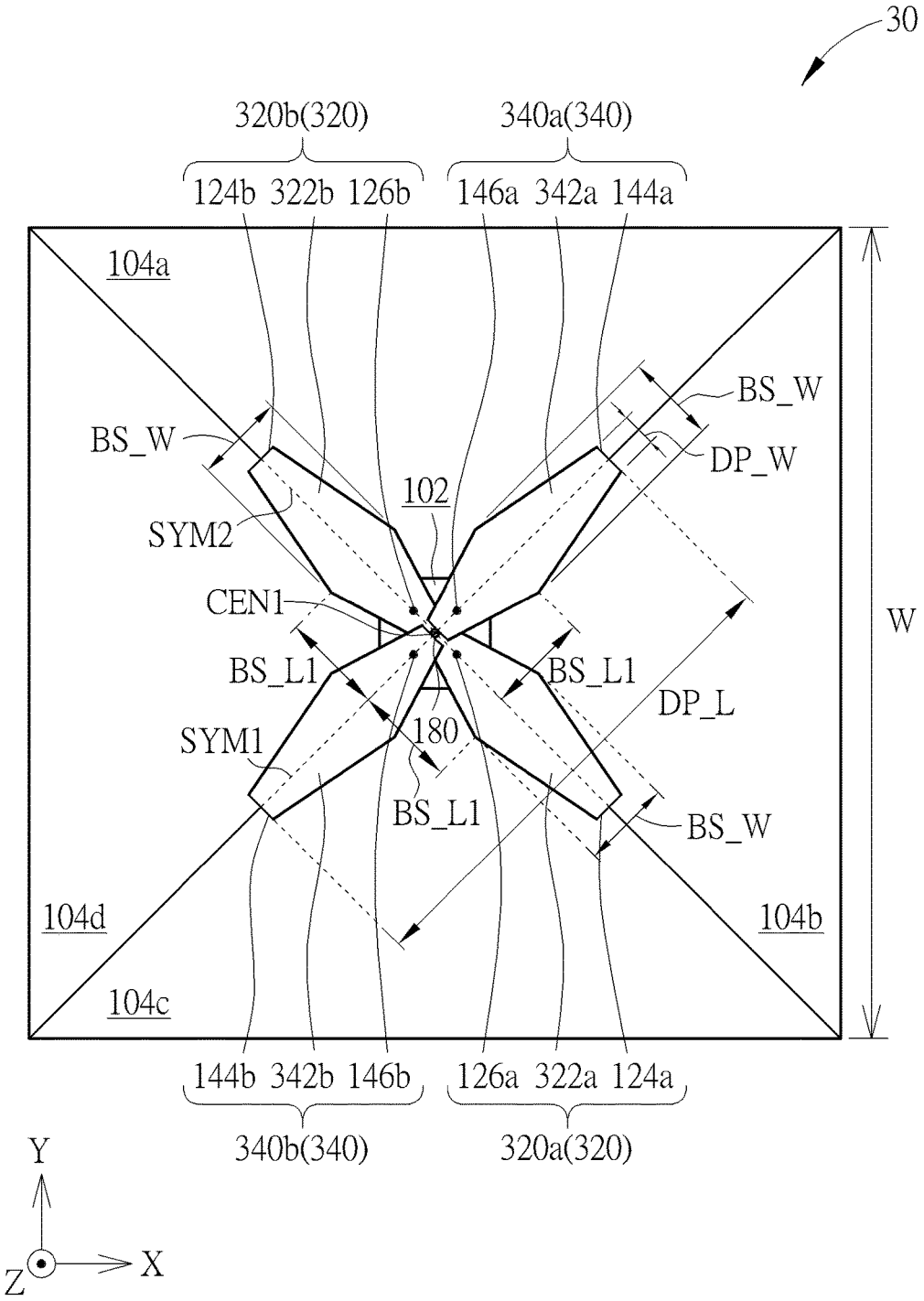
FIG. 3 is a top-view schematic diagram illustrating an antenna according to an embodiment of the present invention.

By adjusting the radiation units 120 and 140 shown in FIG. 1A, the return loss may be improved further. Please refer to FIG. 3. FIG. 3 is a top-view schematic diagram illustrating an antenna 30 according to an embodiment of the present invention. The structure of the antenna 30 is similar to that of the antenna 10 in FIGS. 1A and 1B, and the same numerals and symbols denote the same components in the following description. Since the reflective unit 100 has the frustum structure, the distance from radiation unit 320 or 340 of the antenna 30 to the reflective unit 100 is tough to pin down—the central reflective element 102 of the reflective unit 100 is far from the radiation units 320 and 340, but the peripheral reflective elements 104*a* to 104*d* of the reflective unit 100 are closer to the radiation units 320 and 340. Therefore, main sections 322*a*, 322*b* of the radiation unit 320 and main sections 342*a*, 342*b* of the radiation unit 340 form a bishop hat dipole antenna, respectively, such that a geometrical center (for example, the center of mass) of the main section 322*a* moves toward the centerline CEN1, and geometrical centers of the main sections 322*b*, 342*a* and 342*b* move toward the centerline CEN1 likewise, thereby increase an effective distance between the radiation unit 320 and the reflective unit 100 or between the radiation unit 340 and the reflective unit 100. Besides, a geometrical shape of the antenna 30 is symmetrical with respect to symmetrical axes SYM1 and SYM2. The main sections 322*a* and 322*b* along the symmetrical axis SYM2 reaching a length BS_L1 has a width BS_W to the maximum; the main sections 342*a* and 342*b* along the symmetrical axis SYM1 reaching the length BS_L1 has the width BS_W to the maximum. When the length BS_L1 is reduced to make the points, which correspond to the width BS_W and the length BS_L1, move toward the centerline CEN1, the geometrical centers of the main sections 322*a*, 322*b*, 342*a* and 342*b* also move toward the centerline CEN1 and the return loss (S11) drops. By adjusting a ratio of the width BS_W to the length BS_L1 and a ratio of the width BS_W to a width DP_W, the geometrical centers of the main sections 322*a*, 322*b*, 342*a* and 342*b* may become closer to the centerline CEN1.

Figure 4:
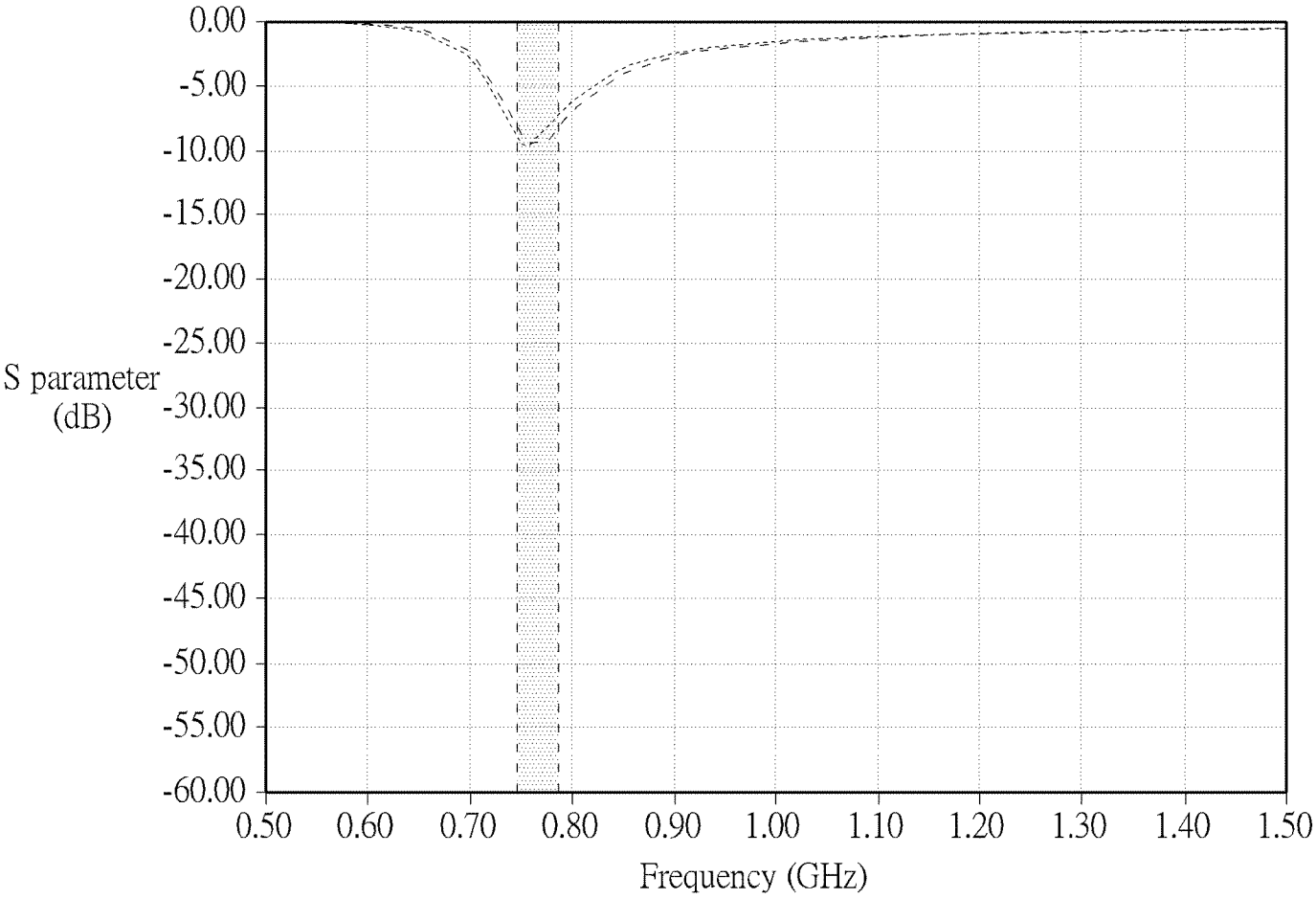
FIG. 4 is a schematic diagram illustrating antenna resonance simulation results of the antenna shown in FIG. 3 with the width set to 25.5 mm.

For example, please refer to Table 2 and FIG. 4. FIG. 4 is a schematic diagram illustrating antenna resonance simulation results of the antenna 30 with the width BS_W set to 25.5 mm. In FIG. 4, antenna resonance simulation results for the radiation unit 320 of the antenna 30 is presented by a long dashed line, and the antenna resonance simulation result for the radiation unit 340 of the antenna 30 is presented by a short dashed line. Antenna isolation simulation results are not shown in FIG. 4 because it is less than −60 dB. Table 2 lists the dimensions and the maximum return loss of the antenna 10 shown in FIG. 2B and those of the antenna 30 shown in FIG. 4, respectively. The total length DP_L and the height DP_H of the antenna 30 shown in FIG. 4 are the same as those of the antenna 10 shown in FIG. 2B respectively; the width DP_W of the antenna 10 shown in FIGS. 2A to 2C is the same as that of the antenna 30 shown in FIG. 4. According to Table 2 and FIG. 4, the return loss of the antenna 30 may be effectively improved to −8.27 dB by adjusting the ratio of the width BS_W to the length BS_L1 and the ratio of the width BS_W to the width DP_W. To prevent the isolation from being affected, it would be better to keep projections of the main sections 322*a*, 322*b*, 342*a*, 342*b* along the axis Z from overlapping as the width BS_W increases to improve the return loss.

TABLE 2

| corre-sponding FIGS. | the width BS_W | the width DP_W | the length BN_L1 | the length BS_L1 | the maximum return loss |
|---|---|---|---|---|---|
| FIG. 2B | 5.15 mm | 5.15 mm | 52.3 mm | 0 mm | −6.97 dB |
| | 12.75 mm | 5.15 mm | 55.4 mm | 17 mm | −7.53 dB |
| FIG. 4 | 25.5 mm | 5.15 mm | 58.4 mm | 17 mm | −8.27 dB |

Figure 5:
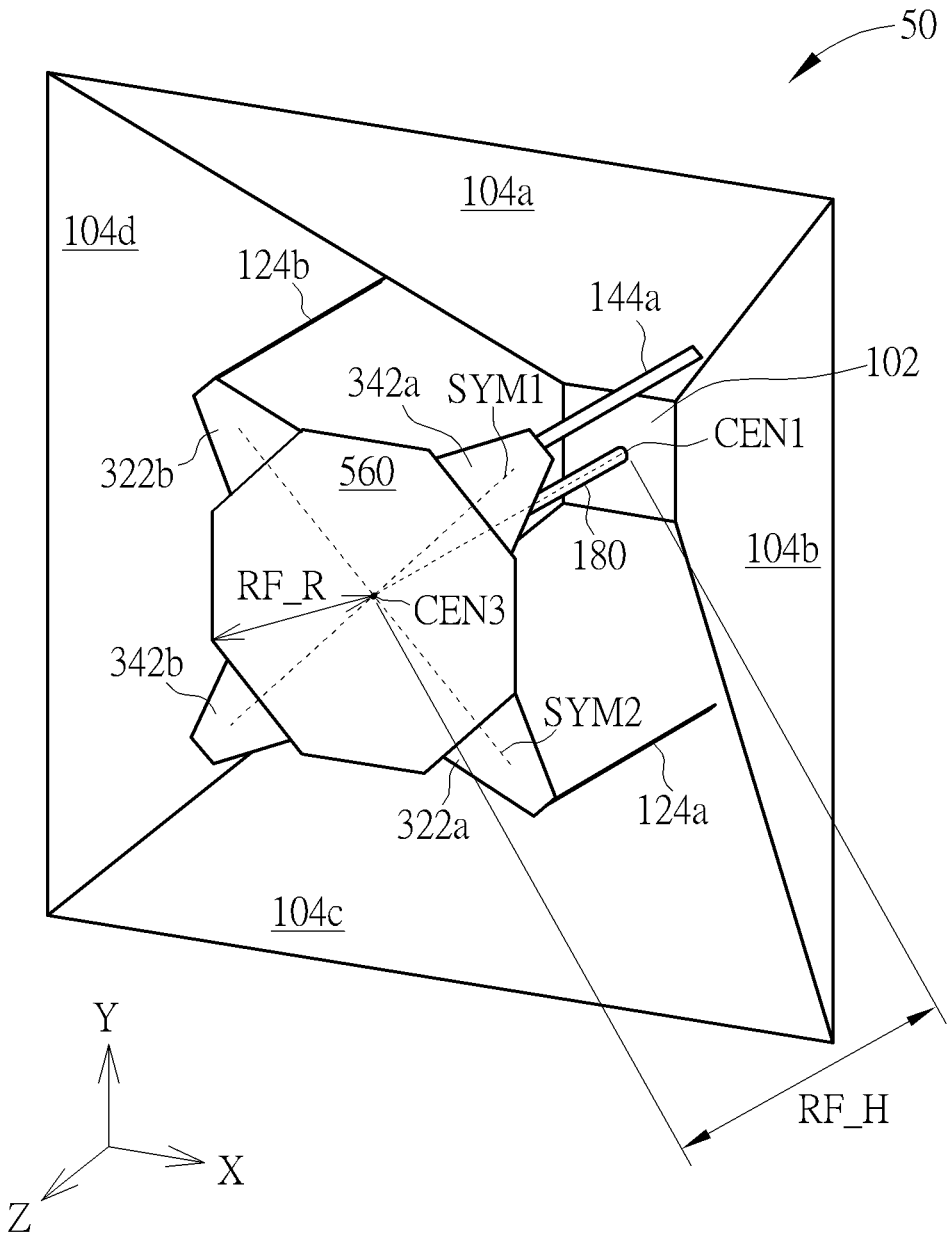
FIG. 5 is a schematic diagram illustrating an antenna according to an embodiment of the present invention.

By adding a reflective plate, the return loss may be improved further. Please refer to FIG. 5. FIG. 5 is a schematic diagram illustrating an antenna 50 according to an embodiment of the present invention. The structure of the antenna 50 is similar to that of the antenna 30 in FIG. 3, and the same numerals and symbols denote the same components in the following description. The antenna 50 further includes a reflective plate 560 to increase effective radiation area of the antenna 50 and to improve effective resonance results of the antenna 50. The reflective plate 560 is disposed above the radiation unit 340 by means of the supporting element 180 and is separated from the central reflective element 102 by the height RF_H, such that the reflective plate 560 is not electrically connected to or contacting the reflective unit 100 or the radiation units 320, 340. To improve common polarization to cross polarization (Co/Cx) parameter, a geometrical shape of the reflective plate 560 has symmetry, and may be a circle or a regular polygon with vertices whose number is a multiple of 4. As shown in FIG. 5, the reflective plate 560 (or its projection on the plane XY) is symmetrical with respect to the symmetrical axes SYM1, SYM2 and the axes X, Y respectively. The centerline CEN1 passes a center CEN3 of the reflective plate 560. Since the antenna 50 is disposed in the cylindrical radome RAD with the radius R1 smaller than one quarter of the operating wavelength, a height RF_H is less than one quarter of the operating wavelength, and a length RF_R from the center CEN3 to each of the vertices of the reflective plate 560 are quite limited.

Figure 6:
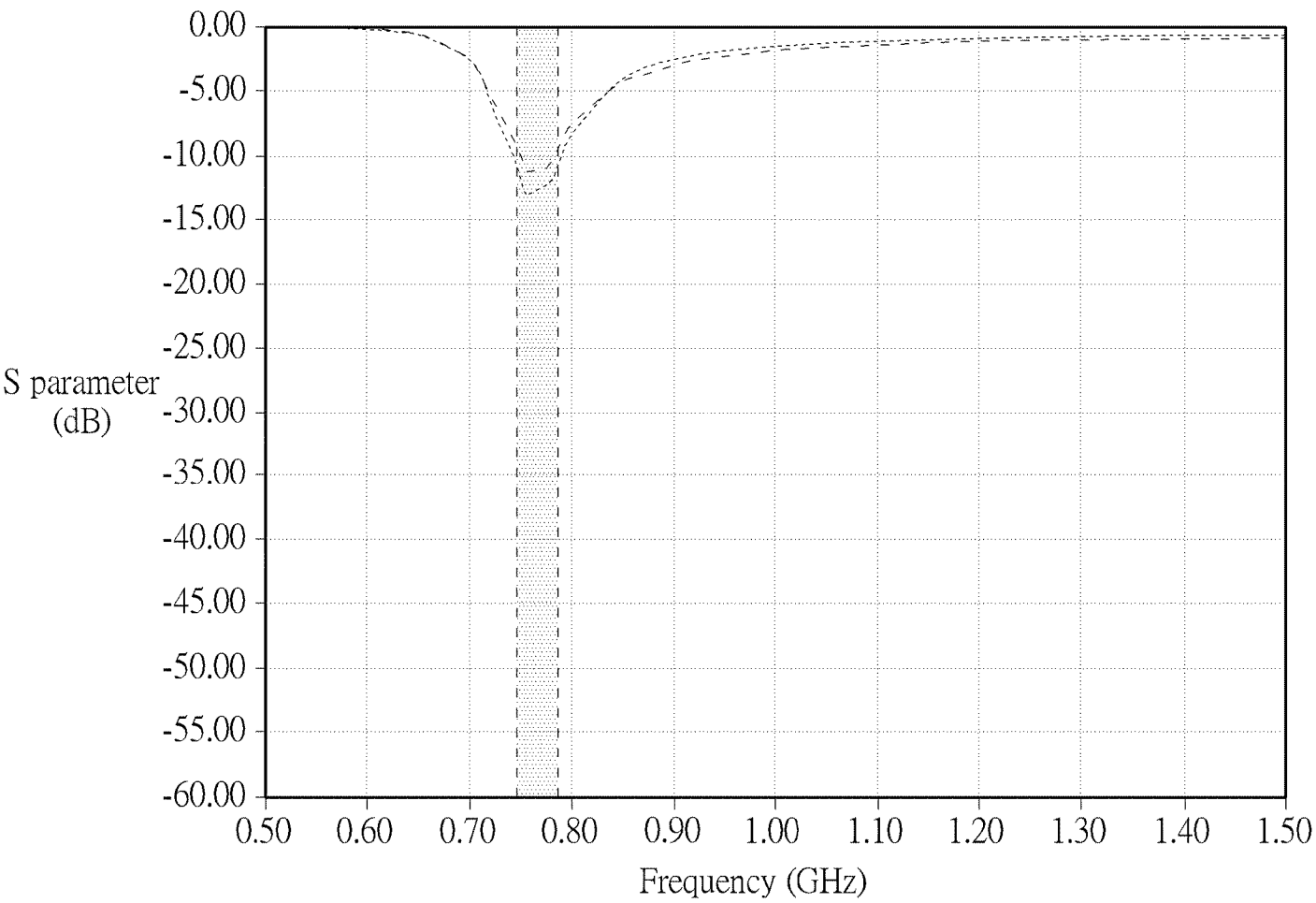
FIG. 6 is a schematic diagram illustrating antenna resonance simulation results of the antenna shown in FIG. 5 with the width set to 25.5 mm.

For example, please refer to Table 3 and FIG. 6. FIG. 6 is a schematic diagram illustrating antenna resonance simulation results of the antenna 50 with the width BS_W set to 25.5 mm. In FIG. 6, antenna resonance simulation results for the radiation unit 320 of the antenna 50 is presented by a long dashed line, and antenna resonance simulation result for the radiation unit 340 of the antenna 50 is presented by a short dashed line. Antenna isolation simulation results are not shown in FIG. 6 because it is less than −60 dB. Table 3 lists dimensions and maximum return loss of the antenna 50 shown in FIG. 6 respectively. The total length DP_L, the length RF_R, the height DP_H, the height RF_H and the width DP_W of the antenna 50 are set to 85 mm, 29 mm, 82 mm, 85.5 mm and 5.15 mm respectively. Comparing FIG. 6 and Table 3 with FIGS. 2B, 4 and Table 2, return loss of the antenna 50 may be effectively improved to −9.38 dB by adding the reflective plate 560.

TABLE 3

| corre-sponding FIGS. | the width BS_W | the length BN_L1 | the length BS_L1 | the maximum return loss |
|---|---|---|---|---|
| | 5.15 mm | 52.3 mm | 0 mm | −8.03 dB |
| | 12.75 mm | 55.4 mm | 17 mm | −8.64 dB |
| FIG. 6 | 25.5 mm | 58.4 mm | 17 mm | −9.38 dB |

Figure 7A:
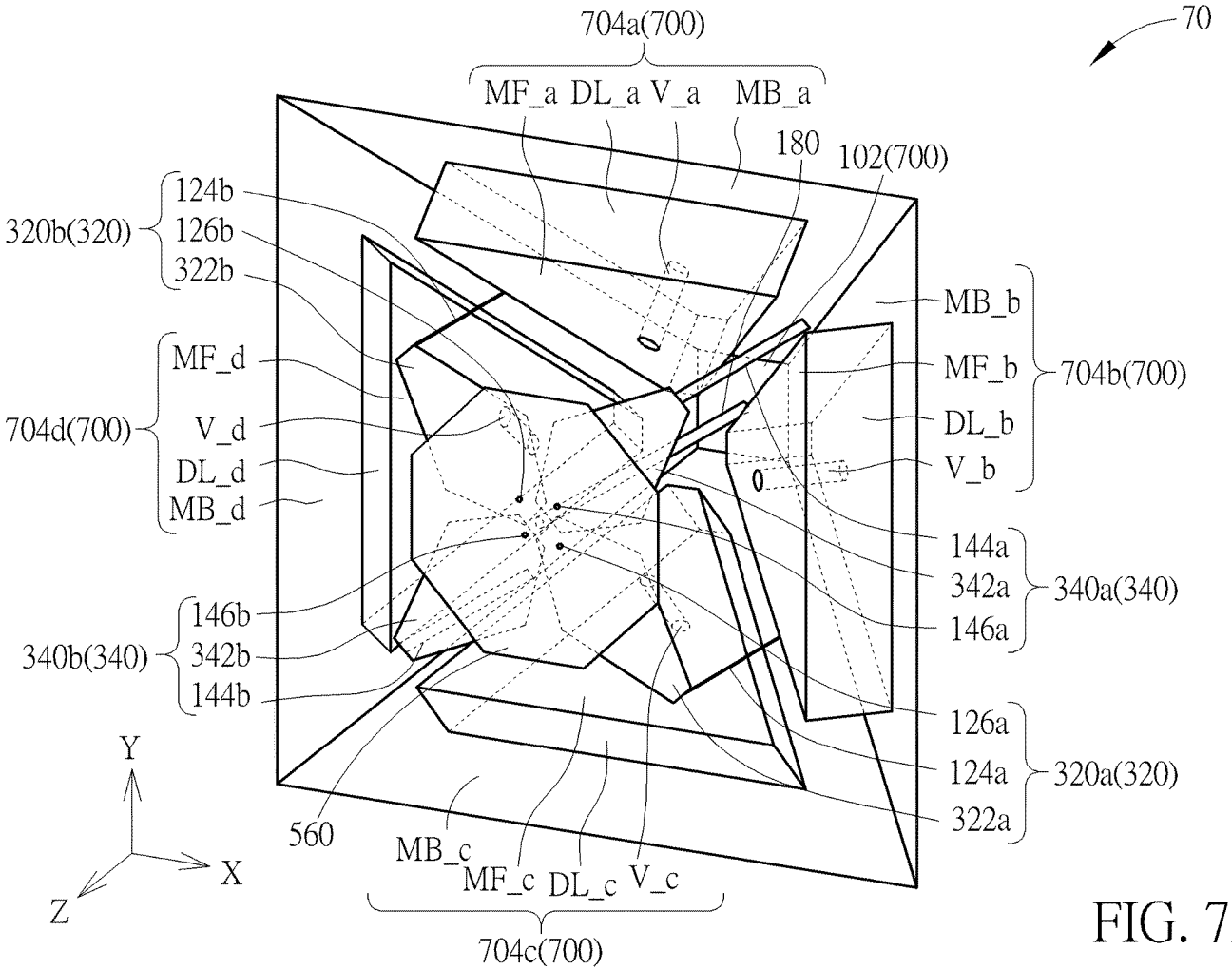
FIG. 7A is a schematic diagram illustrating an antenna according to an embodiment of the present invention.
Figure 7B:
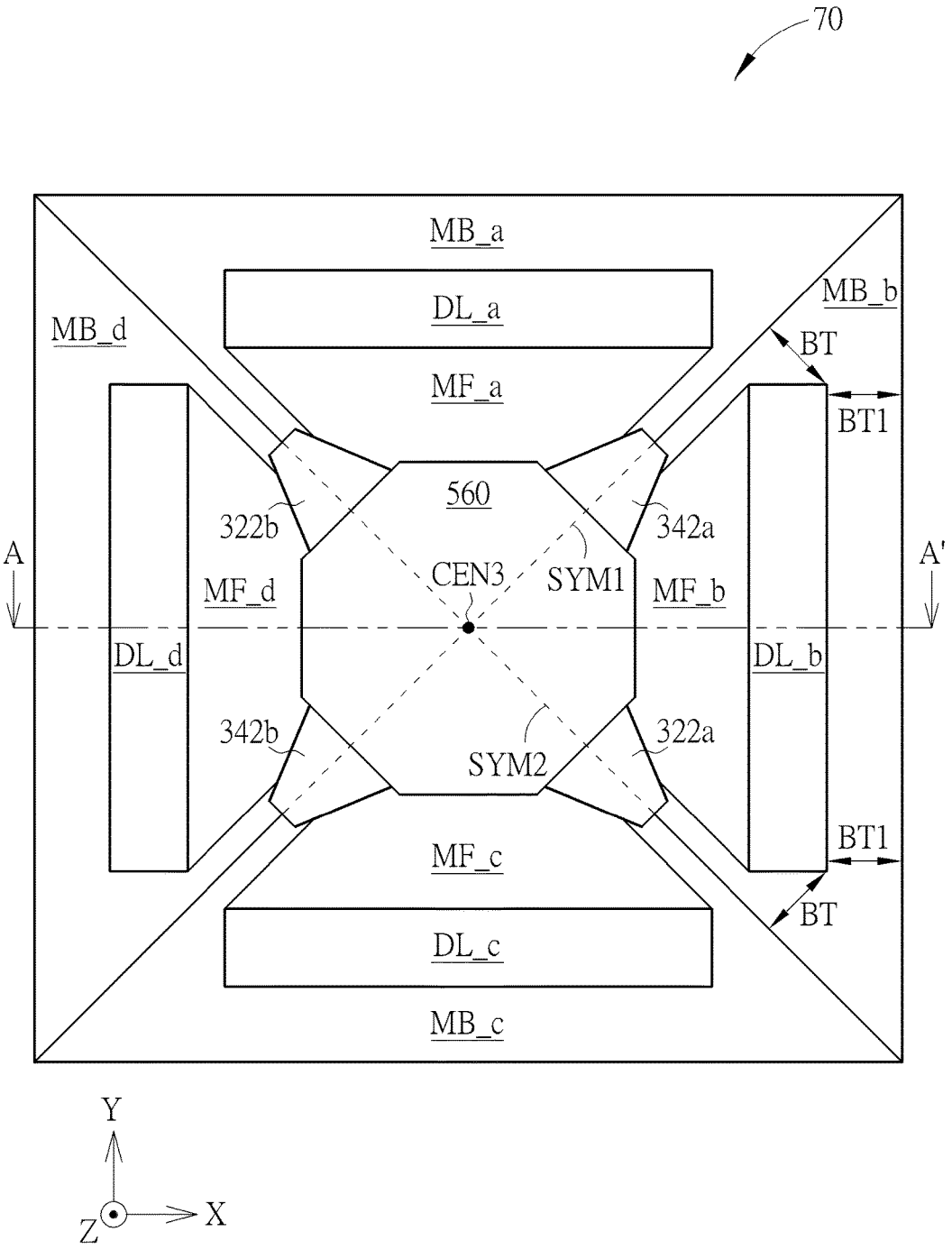
FIG. 7B is a top-view schematic diagram illustrating the antenna shown in FIG. 7A.
Figure 7C:
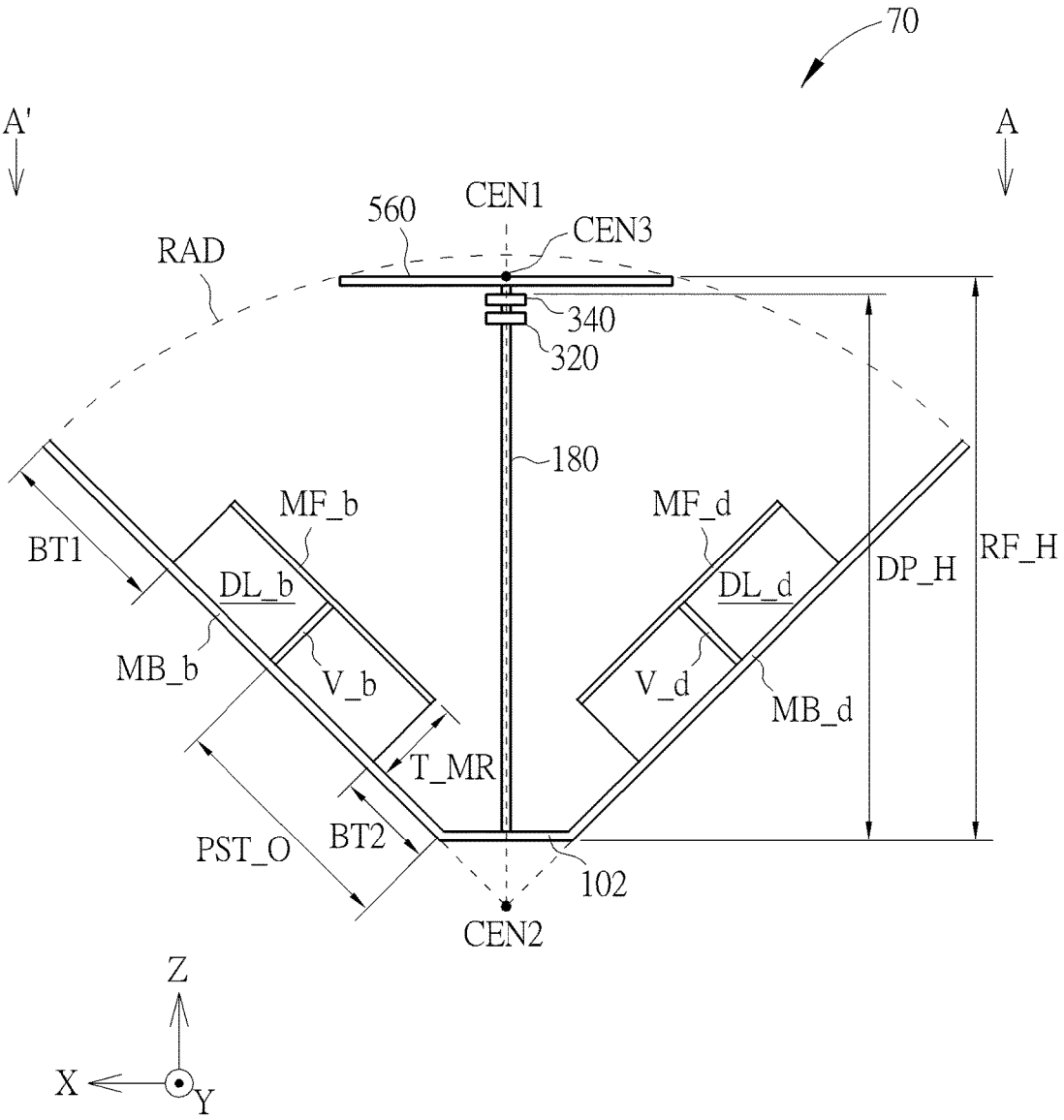
FIG. 7C is a cross-sectional view schematic diagram taken along a cross-sectional line A-A' in FIG. 7B.

By properly designing the reflective unit 100, the return loss may be improved further. Please refer to FIG. 7A to 7C. FIG. 7A is a schematic diagram illustrating an antenna 70 according to an embodiment of the present invention. FIG. 7B is a top-view schematic diagram illustrating the antenna 70. FIG. 7C is a cross-sectional view schematic diagram taken along a cross-sectional line A-A' in FIG. 7B. The structure of the antenna 70 is similar to that of the antenna 50 in FIG. 5, and the same numerals and symbols denote the same components in the following description. Peripheral reflective element 704*a* to 704*d* of a reflective unit 700 of the antenna 70 include conductor base plates MB_a to MB_d, vias V_a to V_d, spacer layers DL_a to DL_d and conductor patches MF_a to MF_d, respectively. Each of the conductor base plates MB_a to MB_d has a shape substantially conforming to an isosceles trapezoid with symmetry, and the conductor base plates MB_a to MB_d enclose the central reflective element 102 symmetrically to form a frustum structure. The shapes of the conductor patches MF_a to MF_d are similar to the shapes of the conductor base plates MB_a to MB_d respectively, meaning that they have the same shape or that one may be obtained from the other by uniformly scaling. The conductor patch MF_a is connected to the conductor base plate MB_a with the via V_a to form a mushroom-type structure, thereby ensuring magnetic conductor reflection effects (i.e., reflection effects of a magnetic conductor). Likewise, the conductor patches MF*b* to MF_d are connected to the conductor base plates MB*b* to MB_d with the vias V*b* to V_d respectively. The spacer layers DL_a to DL_d are disposed to surround or encompass the vias V_a to V_d so that the conductor patches MF_a to MF_d are not electrically connected to or contacting the conductor base plates MB_a to MB_d. The spacer layers DL_a to DL_d may be made of various electrically isolation materials such as air, ceramic, plastic or microwave substrate materials. By properly increasing permittivity of the spacer layers DL_a to DL_d, a size of the antenna 70 may be minimized and the transmission requirements of low frequency may be met efficiently.

Figure 8A:
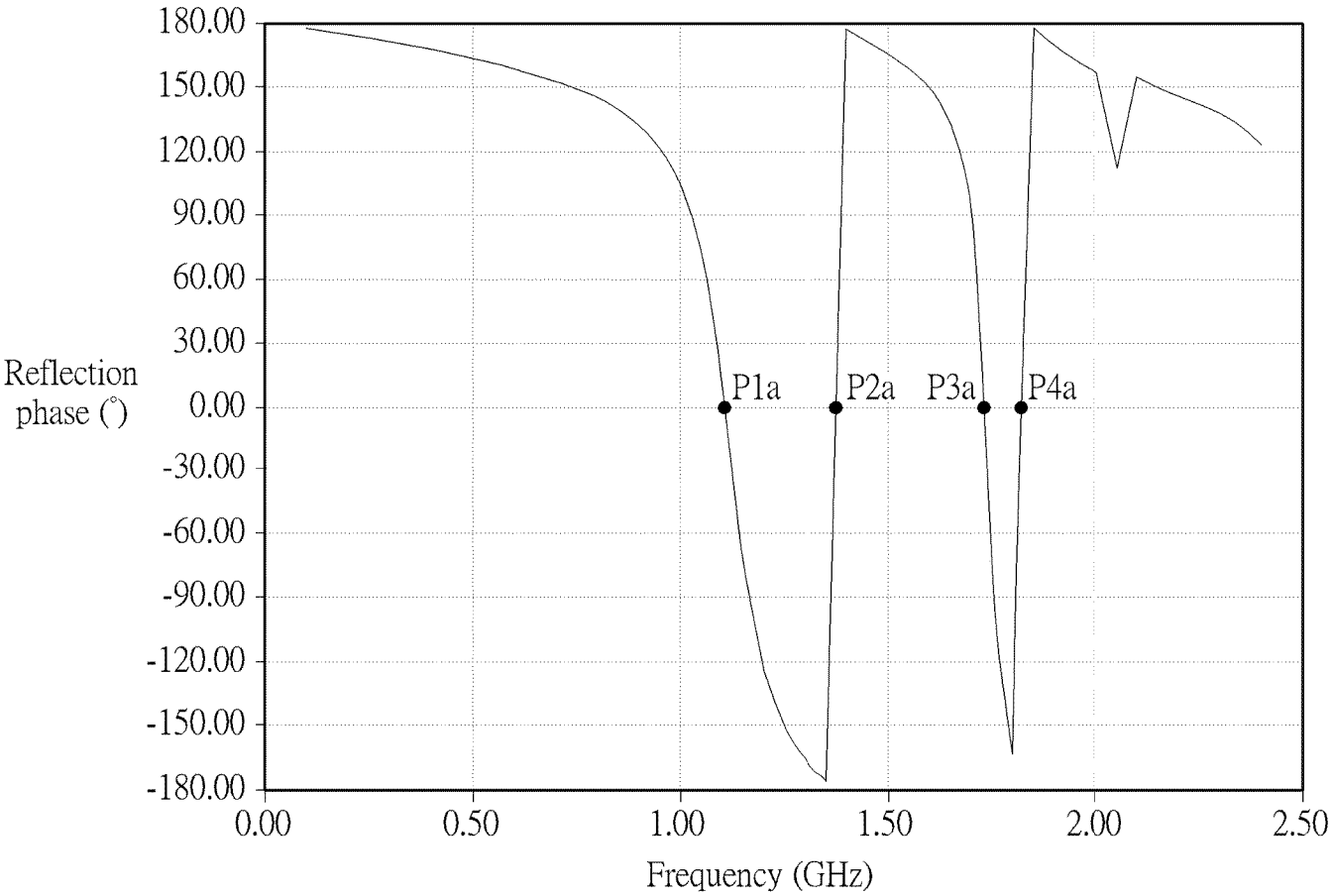
FIGS. 8A and 8B are schematic diagrams illustrating curves representing relationships between frequencies and the reflection phases of the reflective unit of the antenna shown in FIG. 7A when the height of the vias is set to 17.6 mm and 22 mm respectively.
Figure 8B:
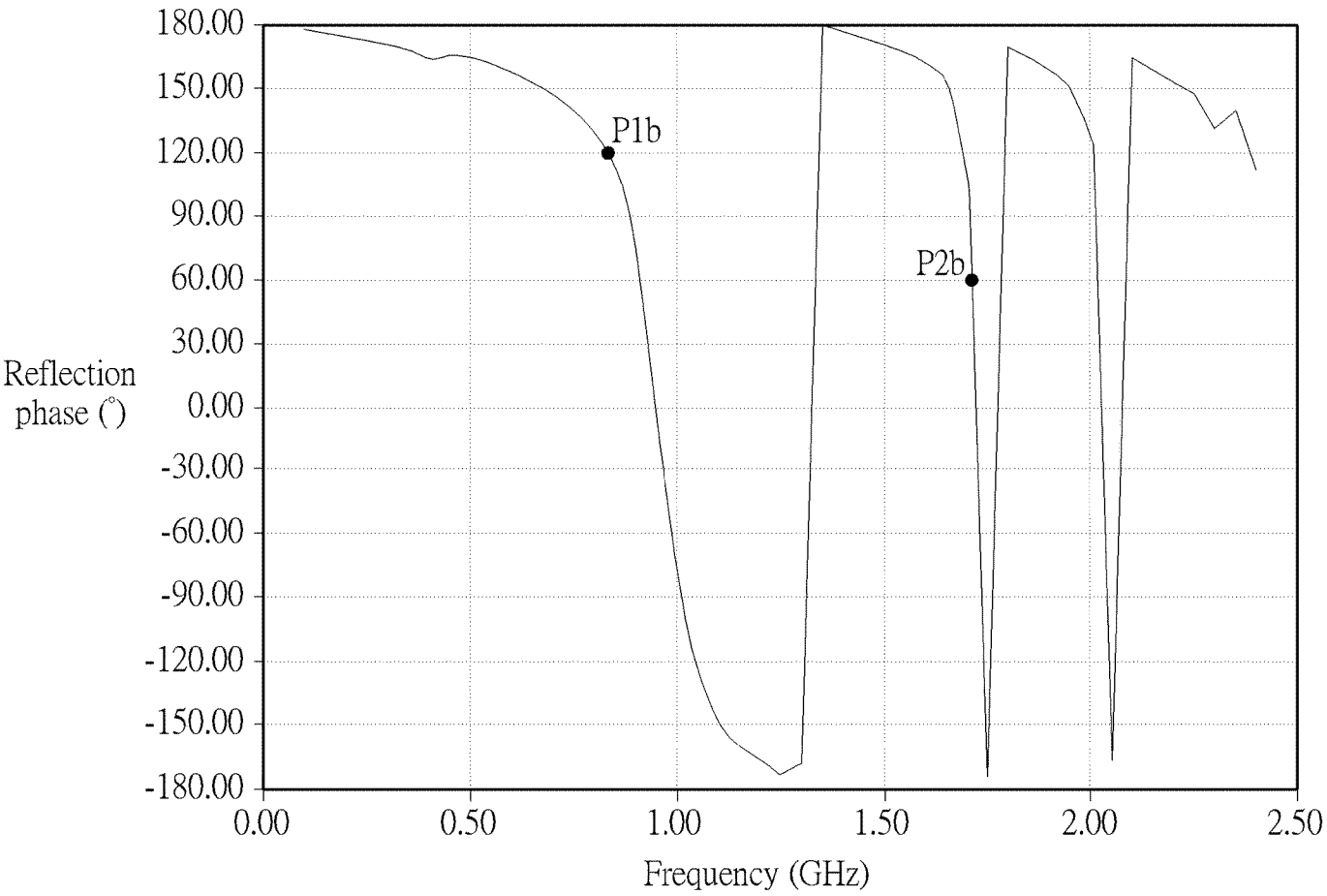

Technically, a conventional artificial magnetic conductor has a periodic structure and thus may alter various reflection phases of electromagnetic waves. However, a conventional artificial magnetic conductor is basically of a plane structure, meaning that it is flat or made by sticking several flat layers together. Unlike a conventional artificial magnetic conductor, the conductor patches MF_a to MF_d of the present invention providing magnetic conductor reflection effects are regularly (or periodically) arranged above the conductor base plates MB_a to MB_d, which are not parallel to each other, thereby presenting the distinct frustum structure of the reflective unit 700. Besides, a radio wave, when reflected from the reflective unit 700, undergoes a phase shift, and this phase shift, which is referred to as a reflection phase of the reflective unit 700 hereafter, is in a range of −180° to 180° corresponding to different frequencies. Therefore, even if the radiation units 320 and 340 are quite close to the reflective unit 700, a reflected radio signal bounced back from the reflective unit 700 may be in phase with its incident radio signal, which is transmitted or received by the radiation unit 320 or 340, thereby achieving constructive interference. As a result, distances between the radiation unit 320 and the reflective unit 700 and between the radiation unit 340 and the reflective unit 700 may be reduced, the size of the antenna 70 may be minimized and the transmission requirements of low frequency may be met efficiently. For example, please refer to FIGS. 8A and 8B. FIGS. 8A and 8B are schematic diagrams illustrating curves representing relationships between frequencies and the reflection phases of the reflective unit 700 of the antenna 70 when a height T_MR of the vias V_a to V_d is set to 17.6 mm and 22 mm respectively. In FIGS. 7B and 7C, projection of edges of the conductor patches MF_a to MF_d projected on the conductor base plates MB_a to MB_d are separated from edges of the conductor base plates MB_a to MB_d by distances BT1, BT, BT2 respectively. The vias V_a to V_d are separated from the central reflective element 102 by a distance PST_O. The distance BT1, BT, BT2, PST_O are set to 12.375 mm, 18.4 mm, 10 mm, 51.5 mm respectively; dielectric constant of the spacer layers DL_a to DL_d is set to 10. As shown in FIGS. 8A and 8B, the reflection phases of the reflective unit 700 are in a range of −180° to 180° corresponding to different frequencies. When a structure or dimensions of the reflective unit 700 are adjusted, a reflection phase of the reflective unit 700 corresponding to a specific frequency is changed. In general, comparing with a conventional antenna having a normal metal plate to serve as its reflective unit, the reflective unit 700 with the reflection phases in a range of −180° to 0° allows reduction in height of the antenna 70 so as to minimize the size of the antenna 70. When a reflection phase of the reflective unit 700 gets closer to 0 degrees, heights of the radiation units 320 and 340 of the antenna 70 becomes lower and the size of the antenna 70 is smaller. Obviously, the size of the antenna 70 may be minimized with the reflective unit 700 having adjustable reflection phases. The structure and the dimensions of the reflective unit 700 may be adjusted appropriately according to the lowest frequency required by the antenna system, such that the reflection phase of the reflective unit 700 corresponding to the lowest frequency gets closer to 0 degrees so as to reduce the size of the antenna 70.

Figure 9A:
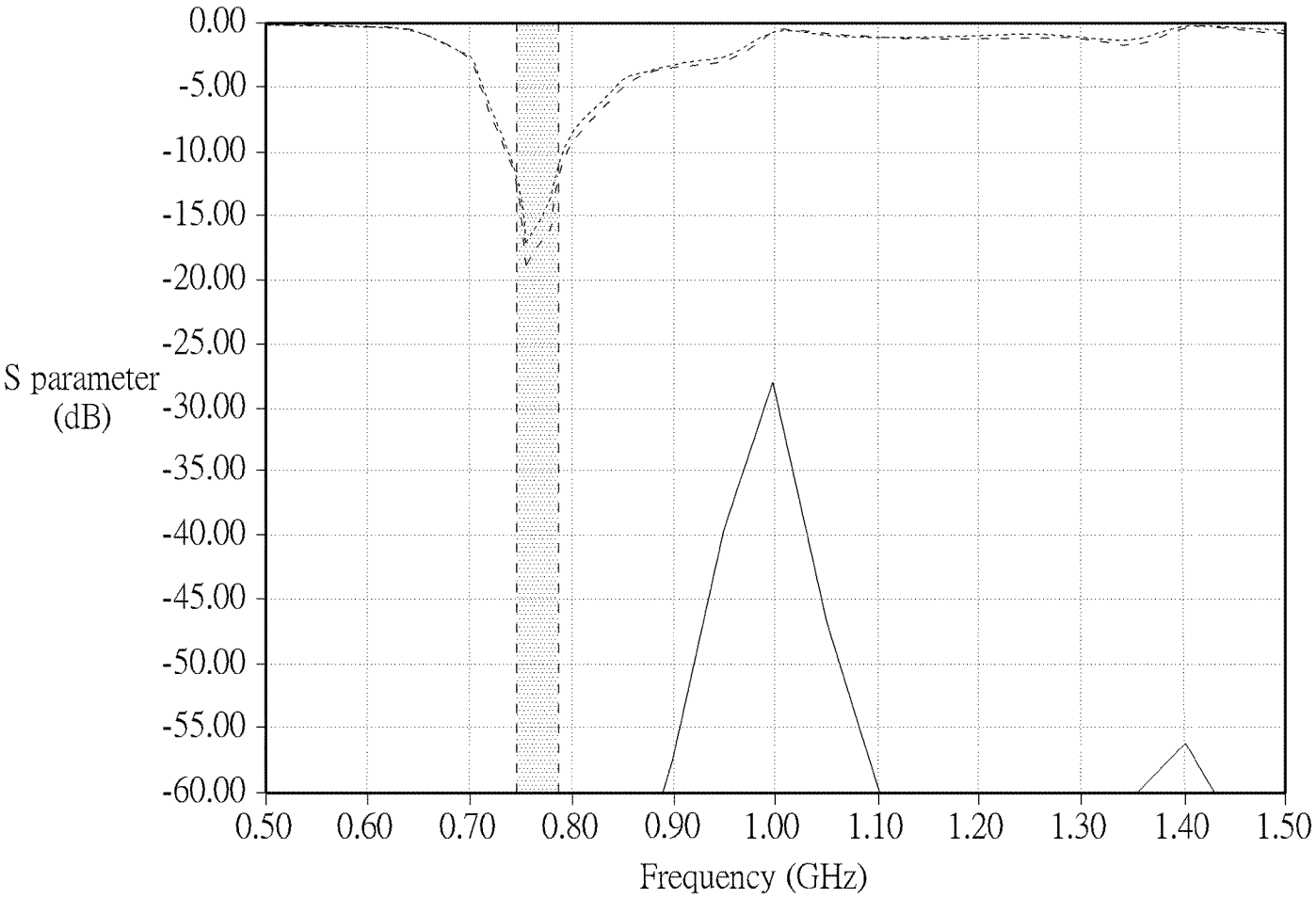
FIGS. 9A and 9B are schematic diagrams illustrating antenna resonance simulation results of the antenna shown in FIG. 7A with the height set to 82 mm and 66.4 mm, respectively.
Figure 9B:
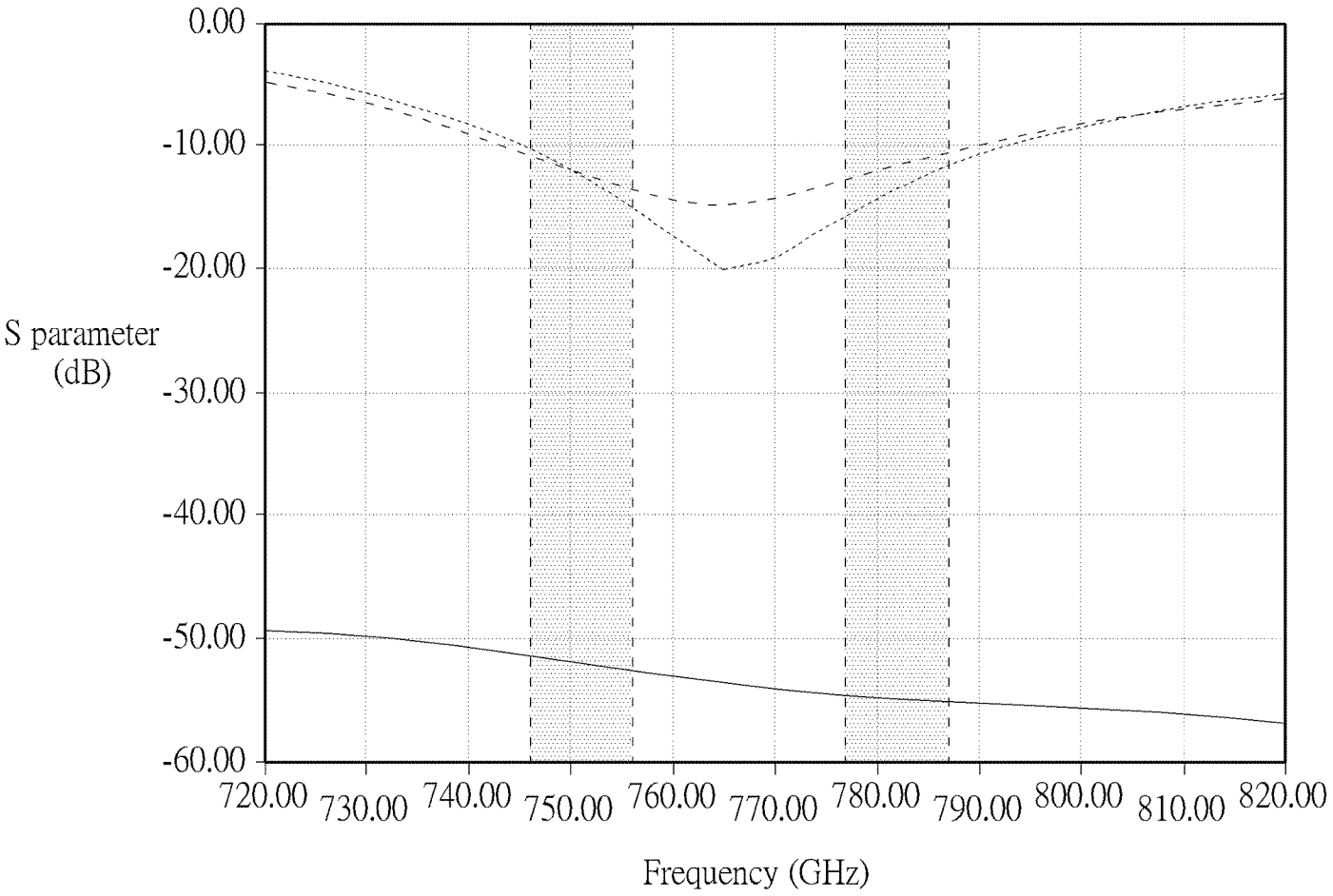

Simulation and measurement may be employed to determine whether the antenna 70 operated at different frequencies meets system requirements. Please refer to Table 4 and FIGS. 9A, 9B. FIGS. 9A and 9B are schematic diagrams illustrating antenna resonance simulation results of the antenna 70 with the height DP_H set to 82 mm and 66.4 mm, respectively. In FIGS. 9A and 9B, antenna resonance simulation results for the radiation unit 320 and 340 of the antenna 70 are presented by a long dashed line and a short dashed line respectively; antenna isolation simulation results between the radiation units 320 and 340 of the antenna 70 is presented by a solid line. Table 4 lists dimensions and maximum return loss of the antenna 70 shown in FIGS. 9A and 9B respectively. The distances BT1, BT, BT2, PST_O and the height T_MR are set to 12.3 mm, 18.4 mm, 11.9 mm, 51.5 mm and 17.5 mm respectively; the dielectric constant of the spacer layers DL_a to DL_d is set to 10. According to Table 4 and FIGS. 9A and 9B, return loss of the radiation units 320 and 340 may be effectively improved to −11.9 dB to meet the requirements of having the return loss less than −10 dB.

TABLE 4

| | | |
|---|---|---|
| the total length DP_L | 85 mm | 137.3 mm |
| the height DP_H | 82 mm | 66.4 mm |
| the length BN_L1 | 58.4 mm | 13.7 mm |
| the width DP_W | 5.15 mm | 3.28 mm |
| the length BS_L1 | 17 mm | 34.1 mm |
| the width BS_W | 25 mm | 50.5 mm |
| the length RF_R | 29 mm | 55.3 mm |
| the height RF_H | 85.5 mm | 74.1 mm |
| the maximum return loss | −11.9 dB | −10.3 dB |

Figure 10:
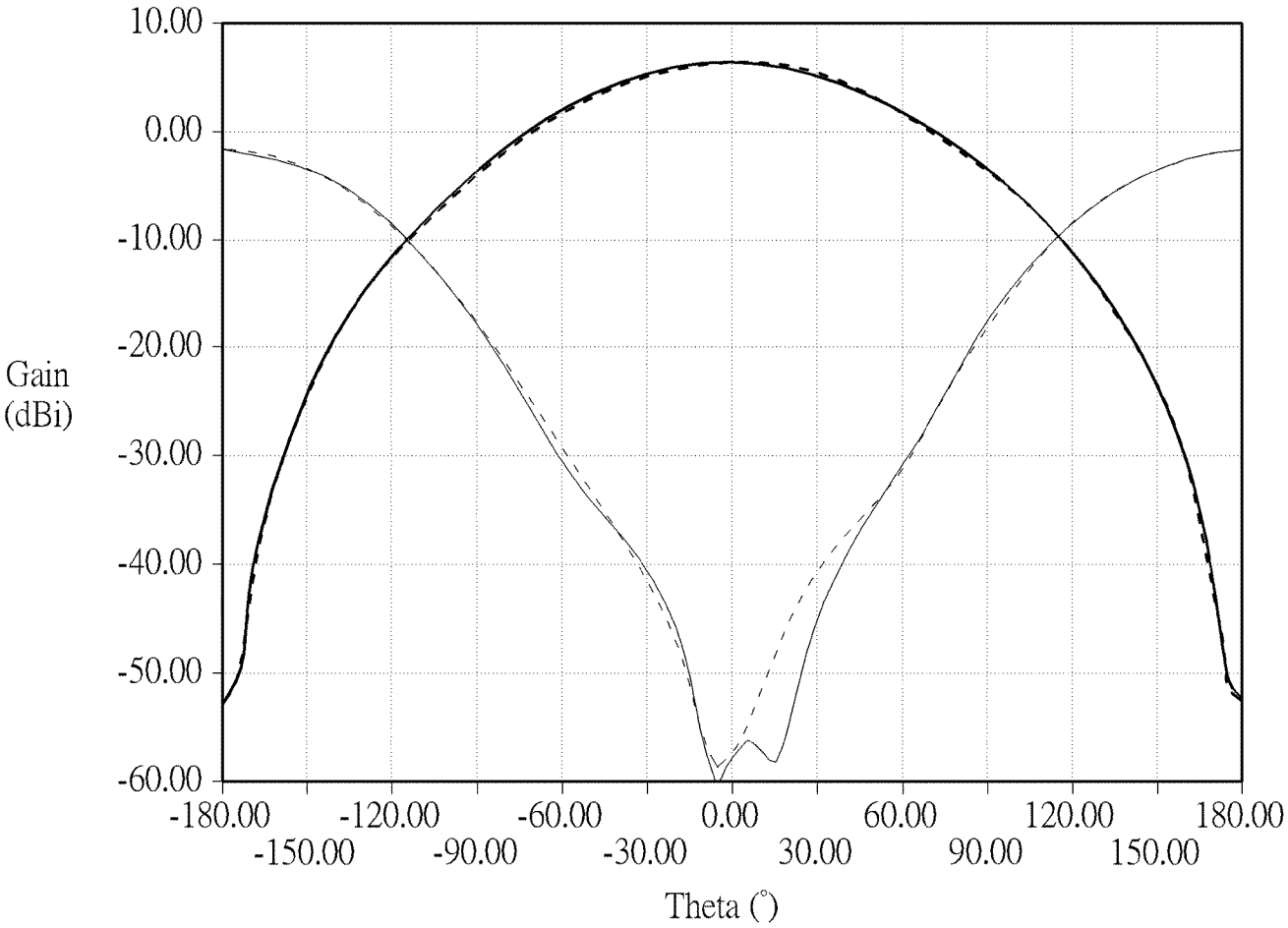
FIG. 10 is a schematic diagram illustrating antenna pattern characteristic simulation results of one radiation unit of the antenna shown in FIG. 9B operated at 777 MHz.
Figure 11:
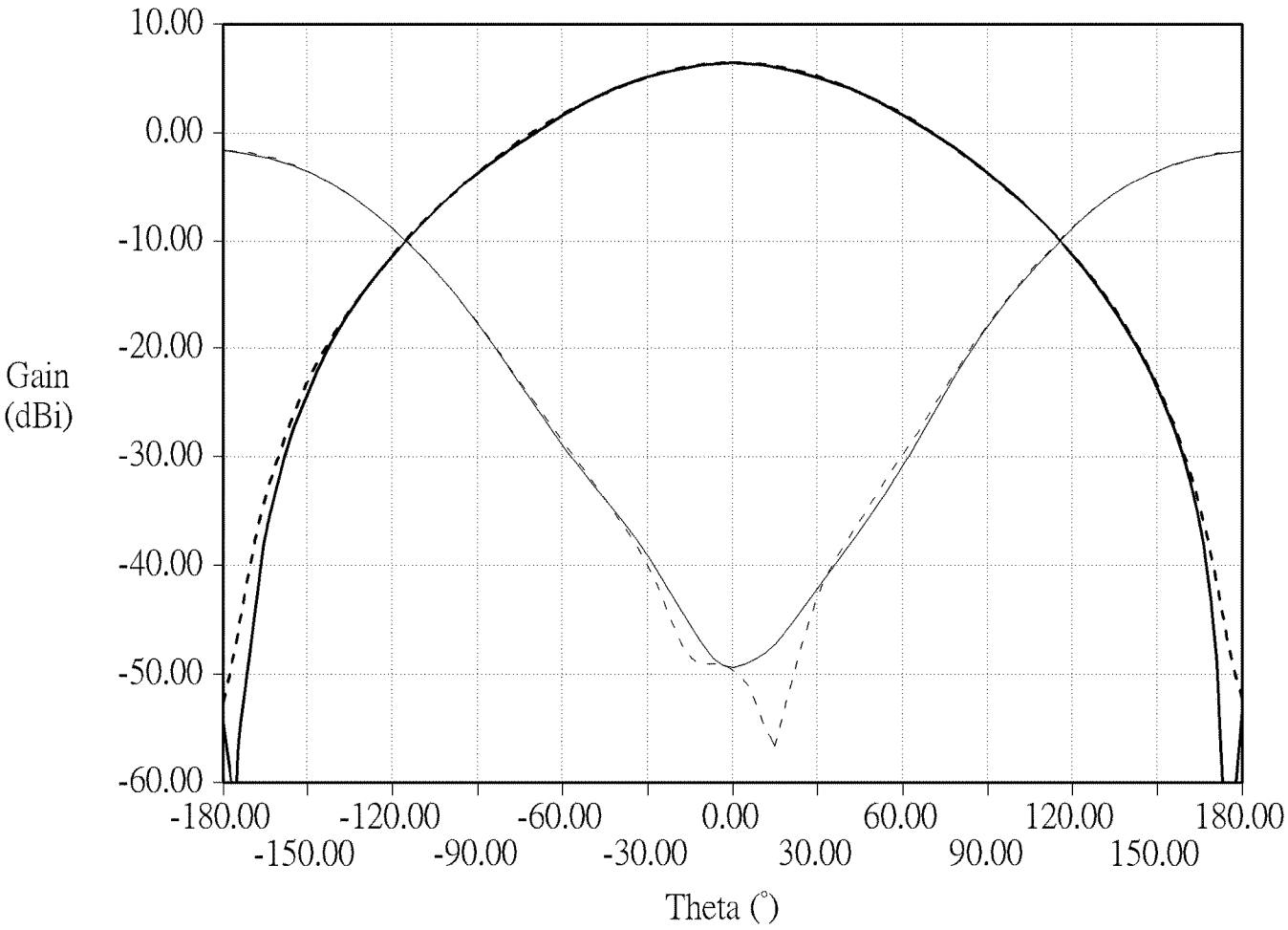
FIG. 11 is a schematic diagram illustrating antenna pattern characteristic simulation results of another radiation unit of the antenna shown in FIG. 9B operated at 777 MHz.

Please refer to Tables 5 to 9 and FIGS. 10, 11. Tables 5 and 6 are field pattern characteristic tables for the radiation unit 320 of the antenna 70 in a horizontal plane (i.e., an H cross-sectional plane) and a vertical plane (i.e., a V cross-sectional plane) shown in FIG. 7A, respectively. Tables 7 and 8 are field pattern characteristic tables for the radiation unit 340 of the antenna 70 in the horizontal plane and the vertical plane shown in FIG. 7A, respectively. Table 9 is a simulation antenna characteristic table for the antenna 70 shown in FIG. 7A. FIG. 10 is a schematic diagram illustrating antenna pattern characteristic simulation results of the radiation unit 320 of the antenna 70 shown in FIG. 7A operated at 777 MHz. FIG. 11 is a schematic diagram illustrating antenna pattern characteristic simulation results of the radiation unit 340 of the antenna 70 shown in FIG. 7A operated at 777 MHz. In FIGS. 10 and 11, a common polarization radiation pattern of the antenna 70 in the horizontal plane (i.e., at 0 degrees) is presented by a thick solid line, a common polarization radiation pattern of the antenna 70 in the vertical plane (i.e., at 90 degrees) is presented by a thick dashed line, a cross polarization radiation pattern of the antenna 70 in the horizontal plane is presented by a thin solid line, and a cross polarization radiation pattern of the antenna 70 in the vertical plane is presented by a thin dashed line. According to Table 9, within Band 13, the return loss of the antenna 70 is at least −10.3 dB, a maximum gain is at least 5.96 dBi, and a common polarization to cross polarization parameter is at least 43.5 dB. Therefore, it is shown that the antenna 70 of the present invention meets LTE wireless communication system requirements of Band 13.

TABLE 5

| corresponding FIGS. | frequency | the maximum gain | 3 dB beamwidth | front-to-back (F/B) ratio | the common polarization to cross polarization (Co/Cx) parameter |
|---|---|---|---|---|---|
| FIG. 10 | 746 MHz | 5.96 dBi | 94 degrees | 7.3 dB | 49.8 dB |
| | 756 MHz | 6.32 dBi | 94 degrees | 7.6 dB | 48.5 dB |
| | 777 MHz | 6.45 dBi | 93 degrees | 8.2 dB | 45.9 dB |
| | 787 MHz | 6.31 dBi | 93 degrees | 8.5 dB | 44.9 dB |

TABLE 6

| corresponding FIGS. | frequency | the maximum gain | 3 dB beamwidth | front-to-back ratio | the common polarization to cross polarization parameter |
|---|---|---|---|---|---|
| FIG. 10 | 746 MHz | 5.96 dBi | 94 degrees | 7.3 dB | 46.7 dB |
| | 756 MHz | 6.32 dBi | 94 degrees | 7.6 dB | 46.9 dB |
| | 777 MHz | 6.45 dBi | 94 degrees | 8.2 dB | 45.6 dB |
| | 787 MHz | 6.31 dBi | 93 degrees | 8.5 dB | 45.0 dB |

TABLE 7

| corresponding FIGS. | frequency | the maximum gain | 3 dB beamwidth | front-to-back ratio | the common polarization to cross polarization parameter |
|---|---|---|---|---|---|
| FIG. 11 | 746 MHz | 5.98 dBi | 94 degrees | 7.3 dB | 47.2 dB |
| | 756 MHz | 6.24 dBi | 94 degrees | 7.6 dB | 46.4 dB |
| | 777 MHz | 6.31 dBi | 94 degrees | 8.2 dB | 44.4 dB |
| | 787 MHz | 6.20 dBi | 93 degrees | 8.5 dB | 43.5 dB |

TABLE 8

| corresponding FIGS. | frequency | the maximum gain | 3 dB beamwidth | front-to-back ratio | the common polarization to cross polarization parameter |
|---|---|---|---|---|---|
| FIG. 11 | 746 MHz | 5.98 dBi | 94 degrees | 7.3 dB | 44.0 dB |
| | 756 MHz | 6.24 dBi | 94 degrees | 7.6 dB | 44.6 dB |
| | 777 MHz | 6.31 dBi | 94 degrees | 8.2 dB | 45.5 dB |
| | 787 MHz | 6.20 dBi | 93 degrees | 8.5 dB | 45.8 dB |

TABLE 9

| frequency band | Band 13 |
|---|---|
| the return loss | >10.3 dB |
| isolation | >51.3 dB |
| the maximum gain | 5.96-6.45 dBi |
| front-to-back ratio | 7.3-8.5 dB |
| 3 dB beamwidth | 93-94 degrees |
| the common polarization to cross polarization parameter | 43.5-49.8 dB |

Please note that the reflection phases of the reflective unit 700 are in a range of −180° to 180° corresponding to different frequencies while variation of the reflection phases corresponding to higher frequencies shown in FIGS. 8A and 8B is large. Taking full advantage of the characteristics of the reflective unit 700, the structure of the antenna 70 is suitable for multiband applications.

Figure 12A:
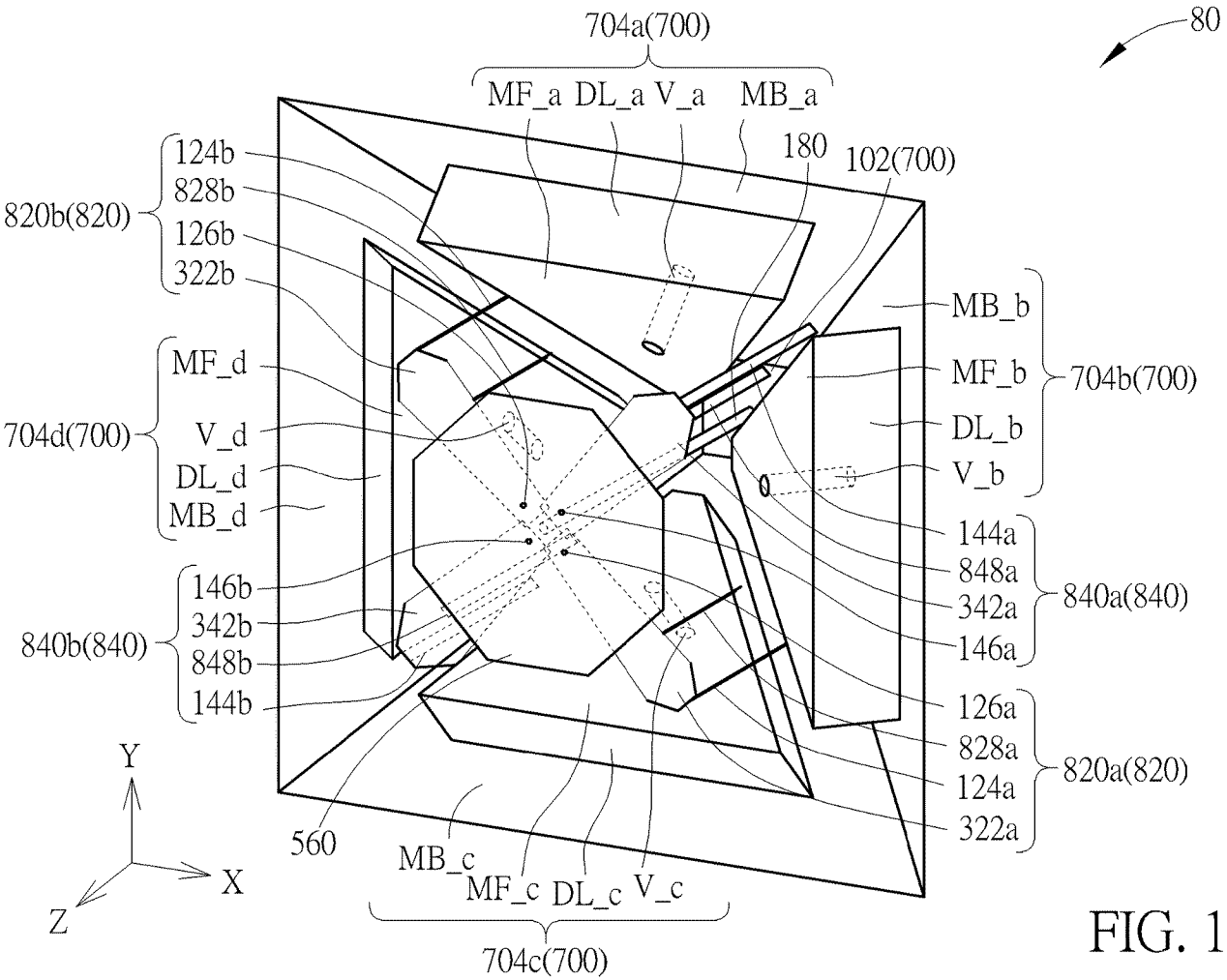
FIG. 12A is a schematic diagram illustrating an antenna according to an embodiment of the present invention.
Figure 12B:
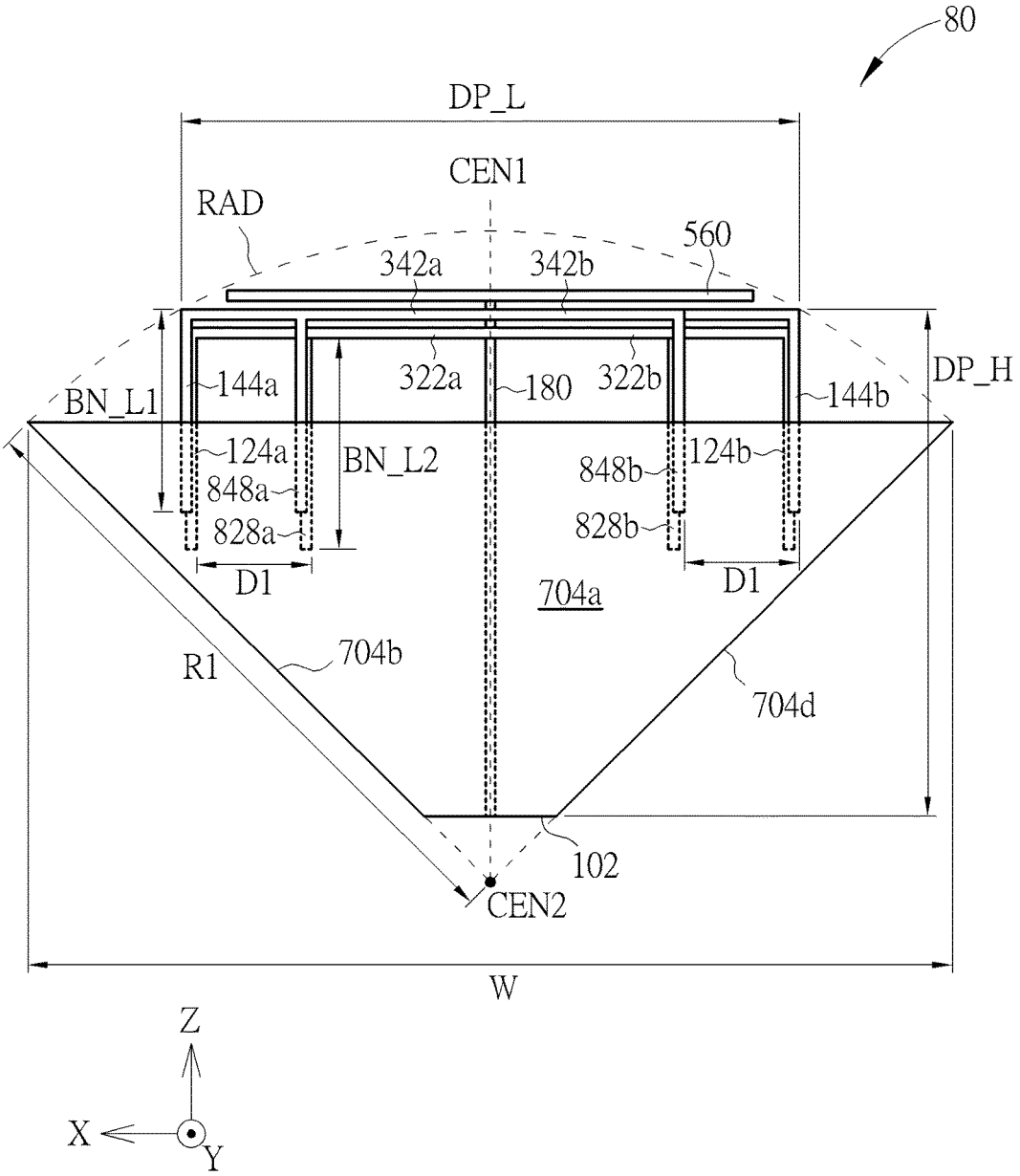
FIG. 12B is a lateral-view schematic diagram illustrating the antenna shown in FIG. 12A.
Figure 12C:
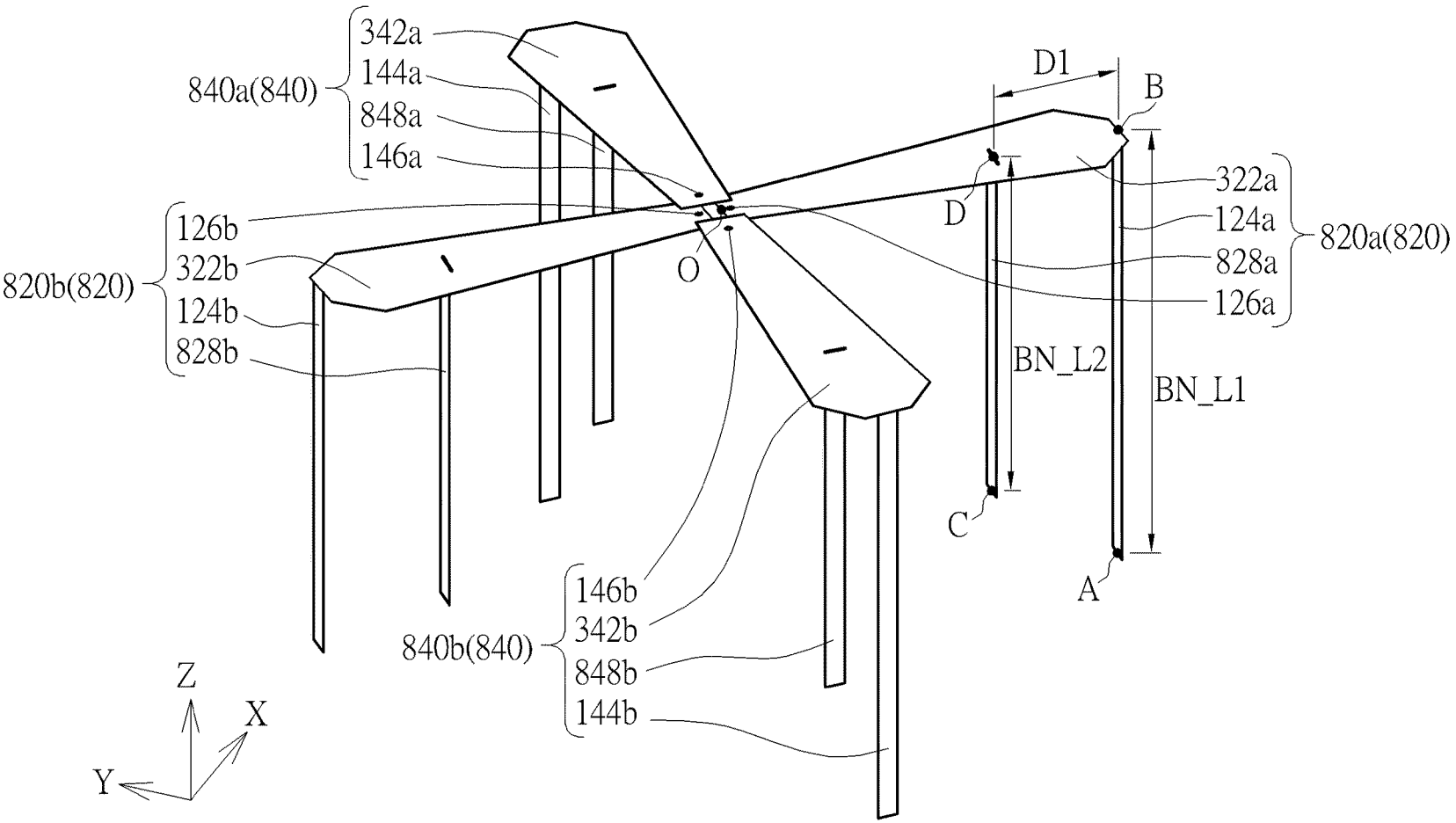
FIG. 12C is a schematic diagram illustrating radiation units of the antenna shown in FIG. 12A.

Please refer to FIGS. 12A to 12C. FIG. 12A is a schematic diagram illustrating an antenna 80 according to an embodiment of the present invention. FIG. 12B is a lateral-view schematic diagram illustrating the antenna 80. FIG. 12C is a schematic diagram illustrating radiation units 820 and 840 of the antenna 80. The structure of the antenna 80 is similar to that of the antenna 70 in FIGS. 7A to 7C, and the same numerals and symbols denote the same components in the following description. The radiation unit 820 includes conductor plates 820*a* and 820*b* with symmetry to form a dipole antenna of 135-degree slant polarized. The conductor plates 820*a* and 820*b* include the main sections 322*a*, 322*b*, the first arm sections 124*a*, 124*b*, second arm sections 828*a*, 828*b* and the feed-in points 126*a*, 126*b*, respectively. As shown in FIGS. 12B and 12C, the ends of the first arm sections 124*a* and 124*b* (e.g., an endpoint B of the first arm section 124*a*) are connected to the ends of the main sections 322*a* and 322*b* (e.g., the endpoint B of the main section 322*a*) respectively, such that a distance between a positively charged side and a negatively charged side becomes longer during resonance so as to enhance radiation effects. Ends of the second arm sections 828*a* and 828*b* (e.g., an endpoint D of the second arm section 828*a*) are connected to different points of the main sections 322*a* and 322*b* (e.g., the point D of the main section 322*a*) respectively. The end of the second arm section 828*a* is separated from the end of the first arm section 124*a* by a distance D1; the end of the second arm section 828*b* is separated from the end of the first arm section 124*b* by the distance D1. Similarly, the radiation unit 840 includes conductor plates 840*a* and 840*b* with symmetry to form a dipole antenna of 45-degree slant polarized. The conductor plates 840*a* and 840*b* include the main sections 342*a*, 342*b*, the first arm sections 144*a*, 144*b*, second arm sections 848*a*, 848*b* and the feed-in points 146*a*, 146*b*, respectively. The ends of the first arm sections 144*a* and 144*b* are connected to the ends of the main sections 342*a* and 342*b* respectively. Ends of the second arm sections 848*a* and 848*b* are connected to different points of the main sections 342*a* and 342*b* respectively. The ends of the second arm sections 848*a* and 848*b* are separated from the ends of the first arm sections 144*a* and 144*b* by the distance D1 respectively. The first arm sections 124*a*, 124*b*, 144*a*, 144*b* and the second arm sections 828*a*, 828*b*, 848*a*, 848*b* are not coplanar to the main sections 322*a*, 322*b*, 342*a* and 342*b* but extending toward the reflective unit 700 respectively.

As shown in FIG. 12C, comparing with a current path ODBA formed of the main section (e.g., from a point O to the endpoint B of the main section 322*a*) and the first arm section (e.g., from the endpoint B to an endpoint A of the first arm section 124*a*), a current path ODC formed of the main section (e.g., from the point O to the point D of the main section 322*a*) and the second arm section (e.g., from the endpoint D to an endpoint C of the second arm section 828*a*) is shorter. Consequently, only the first arm sections 124*a*, 124*b*, 144*a* and 144*b* may resonate at a first resonance frequency, which belongs to low frequency; the second arm sections 828*a*, 828*b*, 848*a* and 848*b* however cannot resonate at the first resonance frequency. In this way, the second arm sections 828*a*, 828*b*, 848*a* and 848*b* would have little or no influence on resonance of the first resonance frequency. Besides, although the first arm sections 124*a*, 124*b*, 144*a*, 144*b* and the second arm sections 828*a*, 828*b*, 848*a*, 848*b* may resonate at a second resonance frequency, which is higher than the first resonance frequency, the first arm sections 124*a*, 124*b*, 144*a* and 144*b* resonate at the second resonance frequency by means of higher order mode, and the second arm sections 828*a*, 828*b*, 848*a* and 848*b* resonate at the second resonance frequency using lower order mode. Because resistance of the lower order mode is smaller than resistance of the higher order mode, resonance of the second resonance frequency tends to occur within the current path formed of the main section and the second arm section (i.e., the current path ODC). In other words, the current path formed of the main section and the first arm section (i.e., the current path ODBA) corresponds to the first resonance frequency, the current path formed of the main section and the second arm section (i.e., the current path ODC) corresponds to the second resonance frequency. The two-arm structure may minimize the mutual influence of the first arm section and the second arm section and provide more design flexibility to structure parameters of multiband applications.

Figure 13:
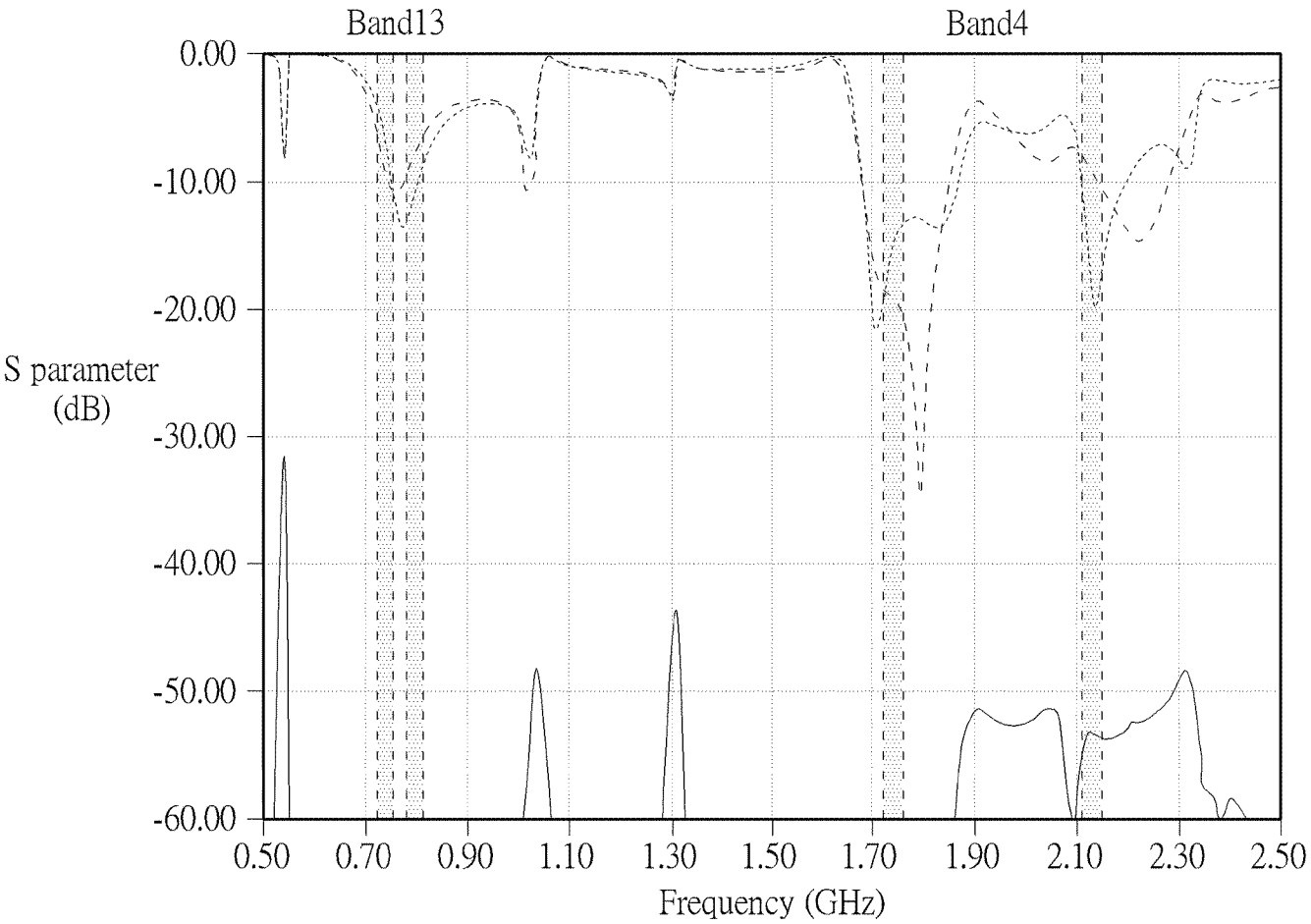
FIG. 13 is a schematic diagram illustrating antenna resonance simulation results of the antenna shown in FIG. 12A.
Figure 14:
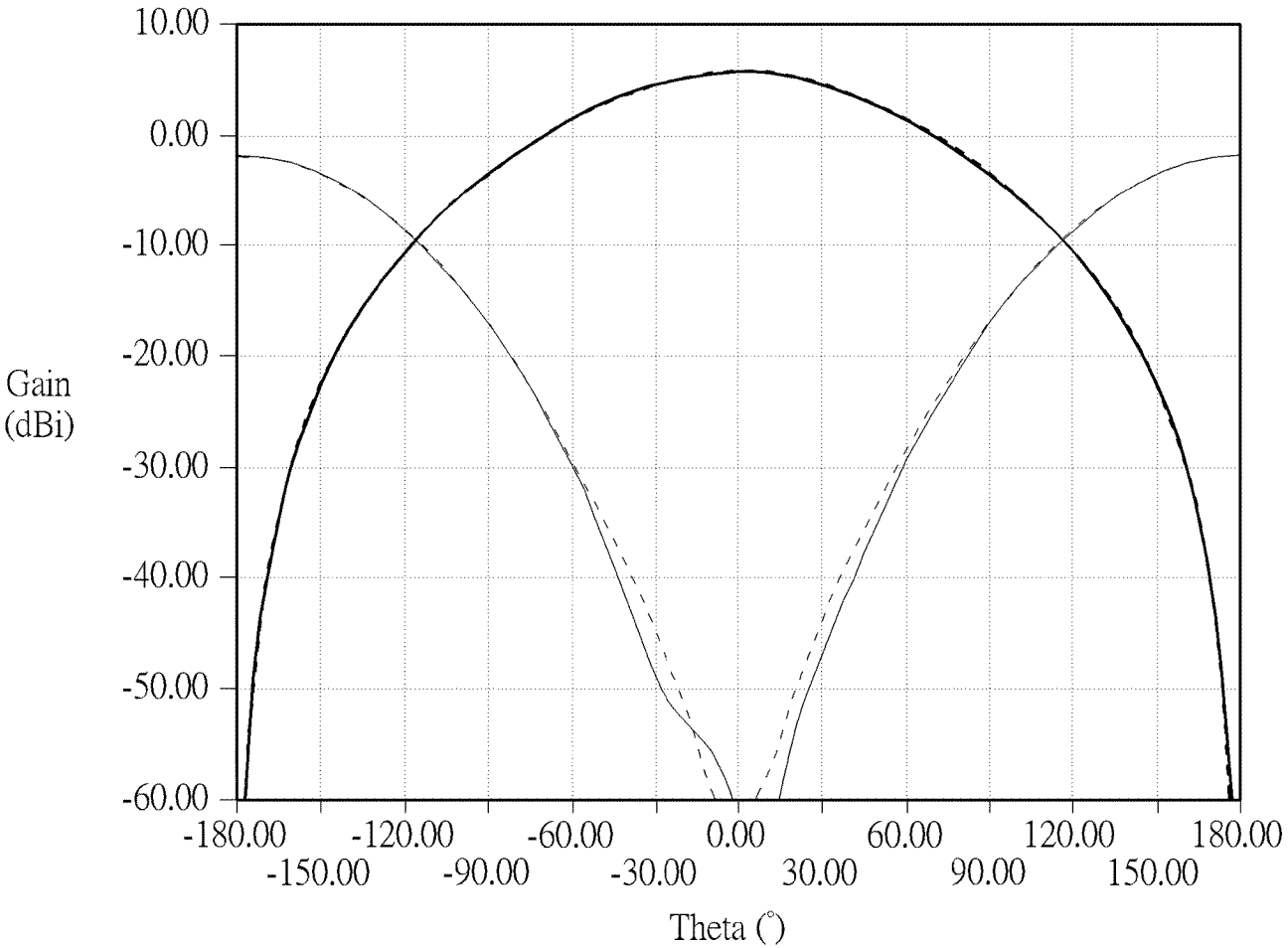
FIG. 14 is a schematic diagram illustrating antenna pattern characteristic simulation results of the radiation unit of the antenna shown in FIG. 12A operated at 777 MHz.

Simulation and measurement may be employed to determine whether the antenna 80 operated at different frequencies meets system requirements. Please refer to Tables 10, 11 and FIGS. 13, 14. FIG. 13 is a schematic diagram illustrating antenna resonance simulation results of the antenna 80. In FIG. 13, the radius R1 of the antenna 80, the base length W of the peripheral reflective elements 704*a* to 704*d* and the height T_MR are set to 99 mm, 140 mm and 11.9 mm, respectively; the dielectric constant of the spacer layers DL_a to DL_d is set to 10. Besides, antenna resonance simulation results for the radiation units 820 and 840 of the antenna 80 are presented by a long dashed line and a short dashed line respectively; antenna isolation simulation results between the radiation units 820 and 840 of the antenna is presented by a solid line. According to FIG. 13, within Band 13 (covering from 746 MHz to 756 MHz and from 777 MHz to 787 MHz) and Band 4 (covering from 1710 MHz to 1755 MHz and from 2110 MHz to 2155 MHz), isolation between the radiation units 820 and 840 is at least 53.2 dB; return loss of the antenna 80 is improved to −8.3 dB. FIG. 14 is a schematic diagram illustrating antenna pattern characteristic simulation results of the radiation unit 840 of the antenna 80 shown in FIG. 12A operated at 777 MHz. In FIG. 14, a common polarization radiation pattern of the antenna 80 in the horizontal plane (i.e., at 0 degrees) is presented by a thick solid line, a common polarization radiation pattern of the antenna 80 in the vertical plane (i.e., at 90 degrees) is presented by a thick dashed line, a cross polarization radiation pattern of the antenna 80 in the horizontal plane is presented by a thin solid line, and a cross polarization radiation pattern of the antenna 80 in the vertical plane is presented by a thin dashed line. Based on FIG. 14, at 777 MHz, front-to-back (F/B) ratio of the antenna 80 is at least 7.5 dB, a maximum gain is at least 5.67 dBi, and a common polarization to cross polarization parameter is at least 51.1 dB. Antenna pattern characteristic simulation results of the radiation unit 840 of the antenna 80 operated at other frequencies or antenna pattern characteristic simulation results of the radiation unit 820 are basically similar to aforementioned illustrations and hence are not detailed redundantly. Tables 10 and 11 are field pattern characteristic tables for the radiation units 820 and 840 of the antenna 80, respectively. According to Tables 10 and 11, within Band 13 and Band 4, the front-to-back ratio of the antenna 80 is at least 6.8 dB, the maximum gain is at least 5.35 dBi, and the common polarization to cross polarization parameter is at least 13.6 dB.

TABLE 10

| corre-sponding FIGS. | fre-quency | the maximum gain | 3 dB beam-width | the front-to-back ratio | the common polarization to cross polarization parameter |
|---|---|---|---|---|---|
| | 746 MHz | 5.53 dBi | 100 degrees | 6.8 dB | 48.1 dB |
| | 756 MHz | 5.69 dBi | 100 degrees | 7.1 dB | 49.1 dB |
| FIG. 14 | 777 MHz | 5.67 dBi | 100 degrees | 7.5 dB | 51.1 dB |
| | 787 MHz | 5.55 dBi | 100 degrees | 7.7 dB | 51.8 dB |
| | 1710 MHz | 8.33 dBi | 69 degrees | 17.1 dB | 22.3 dB |
| | 1755 MHz | 8.13 dBi | 69 degrees | 17.2 dB | 22.3 dB |
| | 2110 MHz | 9.00 dBi | 57 degrees | 17.2 dB | 20.1 dB |
| | 2155 MHz | 10.20 dBi | 49 degrees | 9.8 dB | 13.6 dB |

TABLE 11

| corre-sponding FIGS. | fre-quency | the maximum gain | 3 dB beam-width | the front-to-back ratio | the common polarization to cross polarization parameter |
|---|---|---|---|---|---|
| | 746 MHz | 5.35 dBi | 100 degrees | 6.8 dB | 48.1 dB |
| | 756 MHz | 5.70 dBi | 100 degrees | 7.1 dB | 48.6 dB |
| | 777 MHz | 5.98 dBi | 99 degrees | 7.5 dB | 48.9 dB |
| | 787 MHz | 5.95 dBi | 99 degrees | 7.7 dB | 48.8 dB |
| | 1710 MHz | 8.34 dBi | 70 degrees | 16.7 dB | 22.2 dB |
| | 1755 MHz | 7.90 dBi | 70 degrees | 17.3 dB | 22.0 dB |
| | 2110 MHz | 9.33 dBi | 56 degrees | 17.6 dB | 19.6 dB |
| | 2155 MHz | 10.40 dBi | 48 degrees | 9.8 dB | 14.2 dB |

The antennas 10, 30, 50, 70 and 80 are exemplary embodiments of the invention, and those skilled in the art may make alternations and modifications accordingly. For example, each of the spacer layers DL_a to DL_d may be disposed behind a shield of one of the conductor patches MF_a to MF_d, or overlay one of the conductor base plates MB_a to MB_d to cover it completely. Above each of the conductor base plates MB_a to MB_d, there may be one conductor patch, whose shape is similar to the shape of its corresponding conductor base plate, or more than one conductor patches, which are regularly arranged above the conductor base plate. In addition, the ends of the first arm sections 124*a*, 124*b*, 144*a* and 144*b* of the antenna 80 (e.g., the endpoint B of the first arm section 124*a*) are connected to the ends of the main sections 322*a*, 322*b*, 342*a* and 342*b* (e.g., the endpoint B of the main section 322*a*) respectively; however, the present invention is not limited herein, and the first arm section may be connected to a center of the main section or other locations within the main section (e.g., the point D of the main section 322*a*). Moreover, the first arm sections 124*a*, 124*b*, 144*a*, 144*b* and the second arm sections 828*a*, 828*b*, 848*a*, 848*b* of the antenna 80 may be perpendicular to the main sections 322*a*, 322*b*, 342*a*, 342*b* respectively, such that the first arm sections 124*a*, 124*b*, 144*a*, 144*b* and the second arm sections 828*a*, 828*b*, 848*a*, 848*b* are not coplanar to the main sections 322*a*, 322*b*, 342*a* and 342*b*. Alternatively, there may be an included angle larger or smaller than 90 degrees between each of the first arm sections 124*a*, 124*b*, 144*a*, 144*b* (or each of the second arm sections 828*a*, 828*b*, 848*a*, 848*b*) and each of the main sections 322*a*, 322*b*, 342*a*, 342*b* to keep them not coplanar. In FIGS. 12B and 12C, the first arm sections 124*a*, 124*b*, 144*a*, 144*b* and the second arm sections 828*a*, 828*b*, 848*a*, 848*b* of the antenna 80 are in parallel with each other. Nevertheless, the present invention is not limited to this because the included angle between the first arm section and the main section may be different from the included angle between the second arm section and the main section to make the first arm section and the second arm section unparalleled. As set forth above, the first arm sections 124*a*, 124*b*, 144*a*, 144*b* and the second arm sections 828*a*, 828*b*, 848*a*, 848*b* of the antenna 80 are not coplanar to the main sections 322*a*, 322*b*, 342*a* and 342*b*, but the present invention is not limited herein. Alternatively, the first arm section or the second arm section may be coplanar to the main section; this however hinders minimization of antenna size. In FIGS. 12B and 12C, a length BN_L2 of the second arm section 828*a*, 828*b* is smaller than the length BN_L1 of the first arm section 124*a*, 124*b* but those skilled in the art might make appropriate modifications or alterations according to different design considerations.

Figure 15:
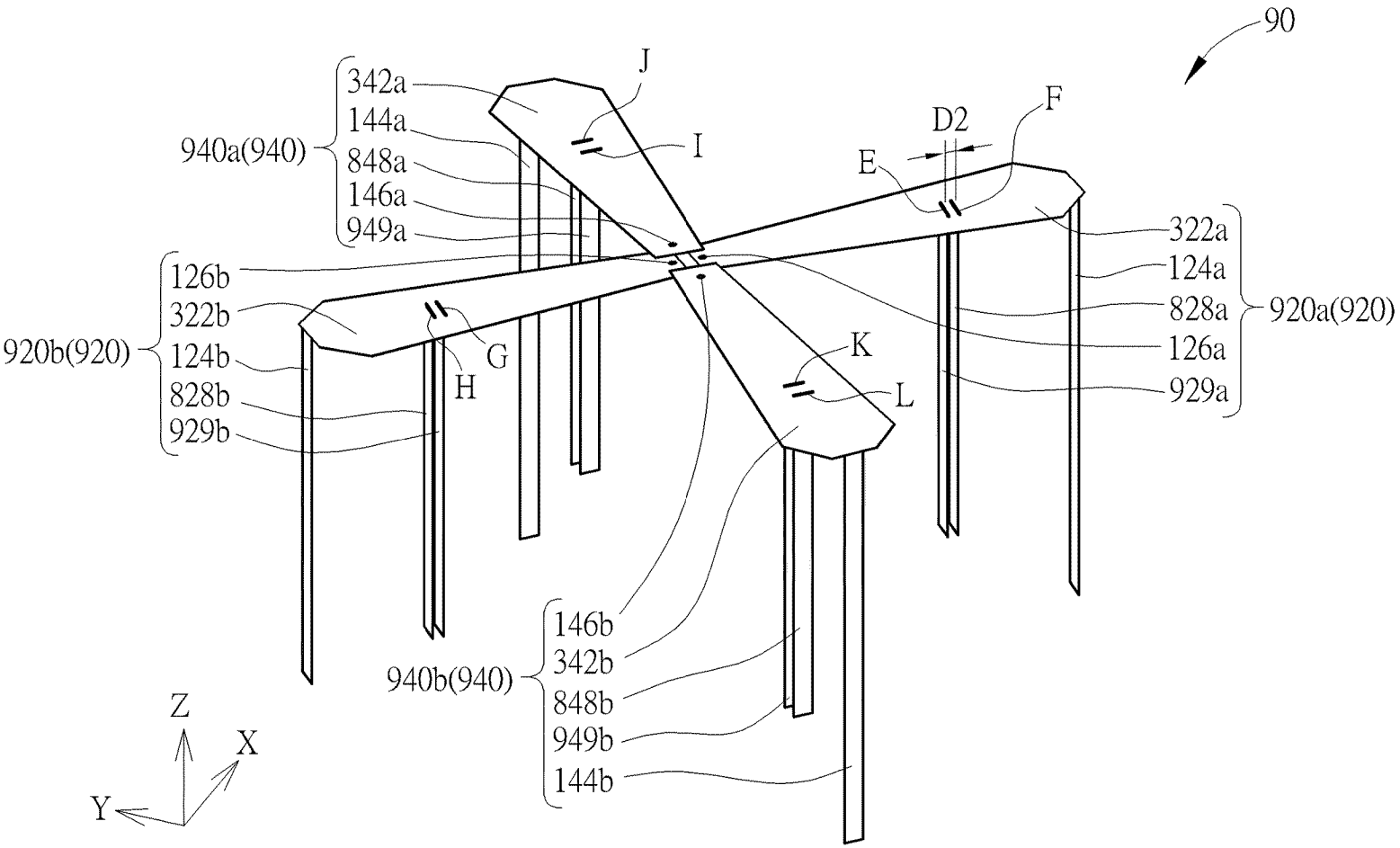
FIG. 15 is a schematic diagram illustrating radiation units of an antenna according to an embodiment of the present invention.

To meet requirements of multiband or wideband transmission, the radiation units 820 and 840 of the antenna 80 need further modifications. Please refer to FIG. 15. FIG. 15 is a schematic diagram illustrating radiation units 920 and 940 of an antenna 90 according to an embodiment of the present invention. The radiation units 920 and 940 may replace the radiation units 820 and 840 of the antenna 80 shown in FIG. 12A. The structure of the antenna 90 is similar to that of the antenna 80 in FIGS. 12A to 12C so that the same numerals and symbols denote the same components in the following description. Unlike the radiation units 820 and 840, the radiation unit 920 includes conductor plates 920*a* and 920*b* with symmetry, and the conductor plates 920*a* and 920*b* further include third arm sections 929*a* and 929*b* respectively. As shown in FIG. 15, the third arm sections 929*a* and 929*b* are connected to the main sections 322*a* and 322*b*. An endpoint E of the third arm section 929*a* is separated from an endpoint F of the second arm section 828*a* by a distance D2; an endpoint G of the third arm section 929*b* is separated from an endpoint H of the second arm section 828*b* by the distance D2. Similarly, the radiation unit 940 includes conductor plates 940*a* and 940*b* with symmetry, and the conductor plates 940*a* and 940*b* further include third arm sections 949*a* and 949*b* respectively. The third arm sections 949*a* and 949*b* are connected to the main sections 342*a* and 342*b*. Endpoints I and K of the third arm sections 949*a* and 949*b* are separated from endpoints J and L of the second arm sections 848*a* and 848*b* by the distance D2, respectively. With the third arm sections 929*a*, 929*b*, 949*a* and 949*b*, the antenna 90 may be operated at broader frequency bands to cover, for example, Band 4.

Figure 16:
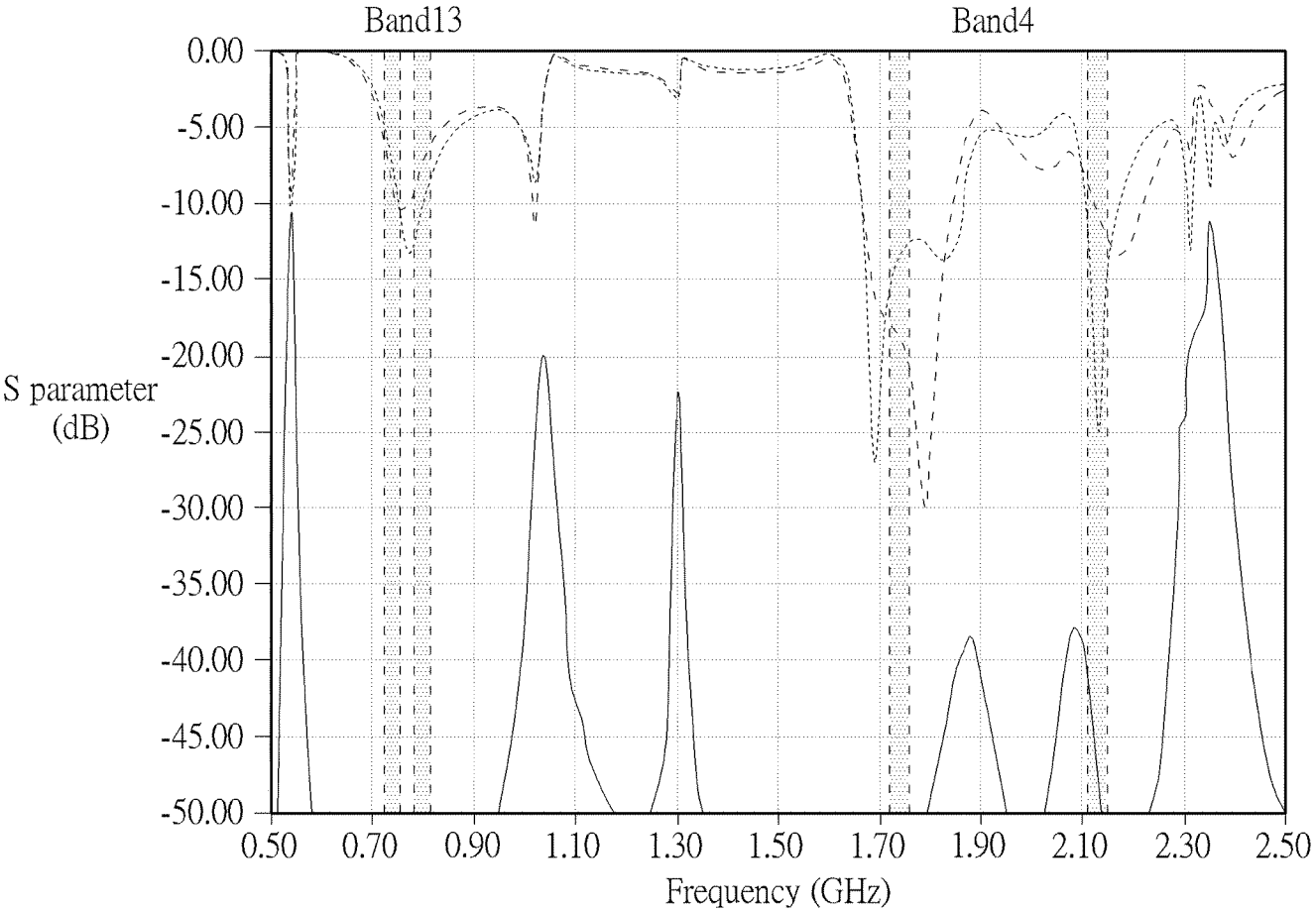
FIG. 16 is a schematic diagram illustrating antenna resonance simulation results of the antenna shown in FIG. 15.
Figure 17:
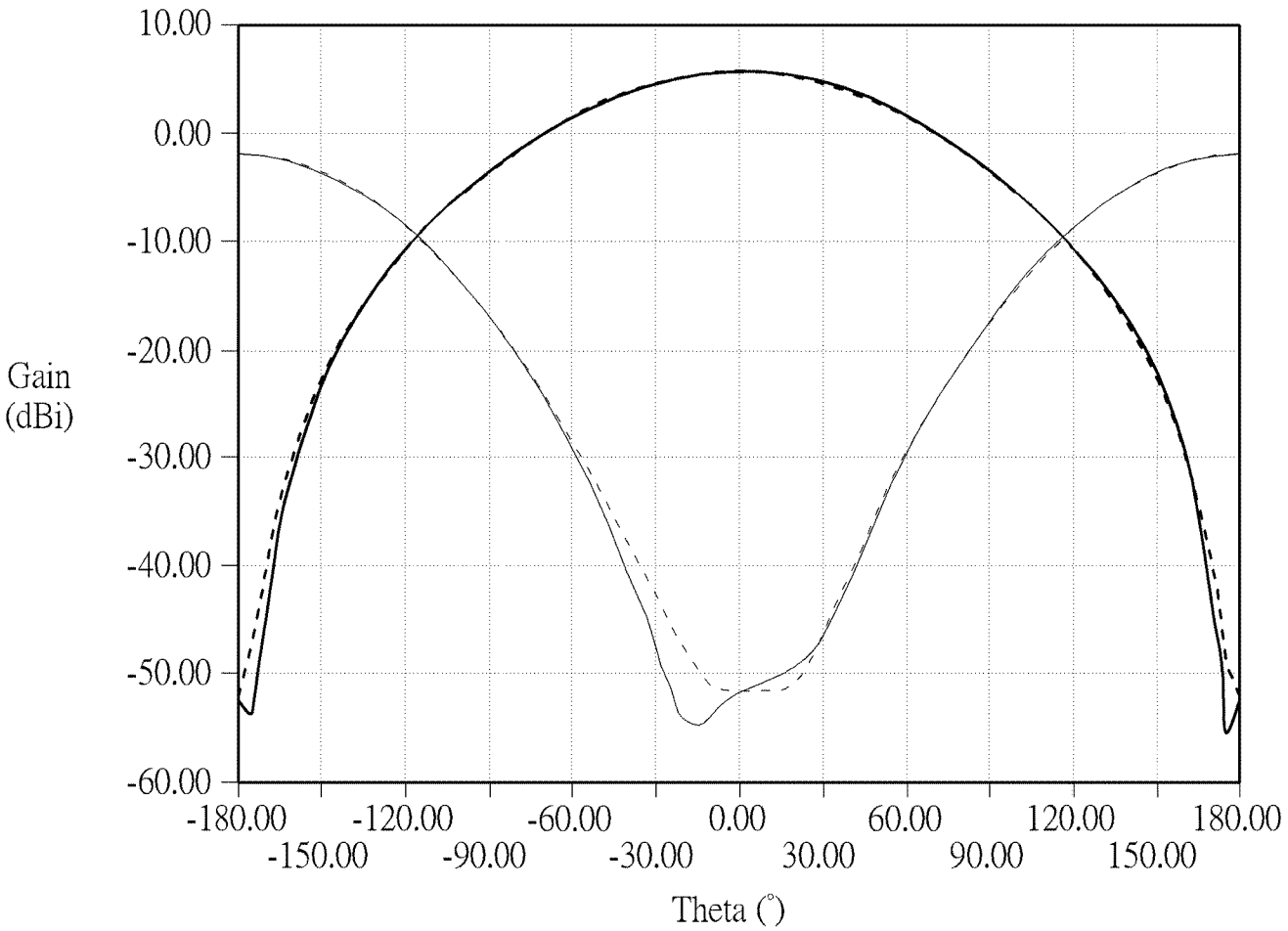
FIG. 17 is a schematic diagram illustrating antenna pattern characteristic simulation results of the radiation unit of the antenna shown in FIG. 15 operated at 777 MHz.

Simulation and measurement may be employed to determine whether the antenna 90 operated at different frequencies meets system requirements. Please refer to Tables 12, 13 and FIGS. 16, 17. FIG. 16 is a schematic diagram illustrating antenna resonance simulation results of the antenna 90. In FIG. 16, the radius R1 of the antenna 90, the base length W of the peripheral reflective elements 704*a* to 704*d* and the height T_MR are set to 99 mm, 140 mm and 11.9 mm, respectively; the dielectric constant of the spacer layers DL_a to DL_d is set to 10. Besides, antenna resonance simulation results for the radiation unit 920 and 940 of the antenna 90 are presented by a long dashed line and a short dashed line respectively; antenna isolation simulation results between the radiation units 920 and 940 of the antenna 90 is presented by a solid line. According to FIG. 16, within Band 13 and Band 4, isolation between the radiation units 820 and 840 is at least 41.7 dB and return loss of the antenna 80 is improved to −8.4 dB. FIG. 17 is a schematic diagram illustrating antenna pattern characteristic simulation results of the radiation unit 940 of the antenna 90 shown in FIG. 15 operated at 777 MHz. In FIG. 17, a common polarization radiation pattern of the antenna 90 in the horizontal plane (i.e., at 0 degrees) is presented by a thick solid line, a common polarization radiation pattern of the antenna 90 in the vertical plane (i.e., at 90 degrees) is presented by a thick dashed line, a cross polarization radiation pattern of the antenna 90 in the horizontal plane is presented by a thin solid line, and a cross polarization radiation pattern of the antenna 90 in the vertical plane is presented by a thin dashed line. Based on FIG. 17, at 777 MHz, front-to-back ratio of the antenna 90 is at least 7.6 dB, a maximum gain is at least 5.62 dBi, and a common polarization to cross polarization parameter is at least 51.0 dB. Antenna pattern characteristic simulation results of the radiation unit 940 of the antenna 90 operated at other frequencies or antenna pattern characteristic simulation results of the radiation unit 920 are basically similar to aforementioned illustrations and hence are not detailed redundantly. Tables 12 and 13 are field pattern characteristic tables for the radiation units 920 and 940 of the antenna 90, respectively. According to Tables 12 and 13, within Band 13 and Band 4, the front-to-back ratio of the antenna 90 is at least 6.9 dB, the maximum gain is at least 5.41 dBi, and the common polarization to cross polarization parameter is at least 12.3 dB.

TABLE 12

| corre-sponding FIGS. | fre-quency | the maximum gain | 3 dB beam-width | the front-to-back ratio | the common polarization to cross polarization parameter |
|---|---|---|---|---|---|
| | 746 MHz | 5.51 dBi | 100 degrees | 6.9 dB | 49.6 dB |
| | 756 MHz | 5.65 dBi | 100 degrees | 7.1 dB | 50.7 dB |
| FIG. 17 | 777 MHz | 5.62 dBi | 100 degrees | 7.6 dB | 51.0 dB |
| | 787 MHz | 5.50 dBi | 100 degrees | 7.8 dB | 50.0 dB |
| | 1710 MHz | 8.44 dBi | 68 degrees | 15.5 dB | 22.3 dB |
| | 1755 MHz | 8.29 dBi | 67 degrees | 15.6 dB | 21.7 dB |
| | 2110 MHz | 9.87 dBi | 50 degrees | 15.4 dB | 18.9 dB |
| | 2155 MHz | 10.70 dBi | 44 degrees | 9.7 dB | 12.3 dB |

TABLE 13

| corre-sponding FIGS. | fre-quency | the maximum gain | 3 dB beam-width | the front-to-back ratio | the common polarization to cross polarization parameter |
|---|---|---|---|---|---|
| | 746 MHz | 5.41 dBi | 100 degrees | 6.9 dB | 45.9 dB |
| | 756 MHz | 5.73 dBi | 100 degrees | 7.1 dB | 46.9 dB |
| | 777 MHz | 5.96 dBi | 100 degrees | 7.6 dB | 48.0 dB |
| | 787 MHz | 5.93 dBi | 100 degrees | 7.8 dB | 47.9 dB |
| | 1710 MHz | 8.45 dBi | 67 degrees | 15.9 dB | 21.4 dB |
| | 1755 MHz | 8.06 dBi | 66 degrees | 16.0 dB | 20.8 dB |
| | 2110 MHz | 10.10 dBi | 51 degrees | 14.6 dB | 20.0 dB |
| | 2155 MHz | 10.50 dBi | 44 degrees | 9.1 dB | 12.9 dB |

Figure 18:
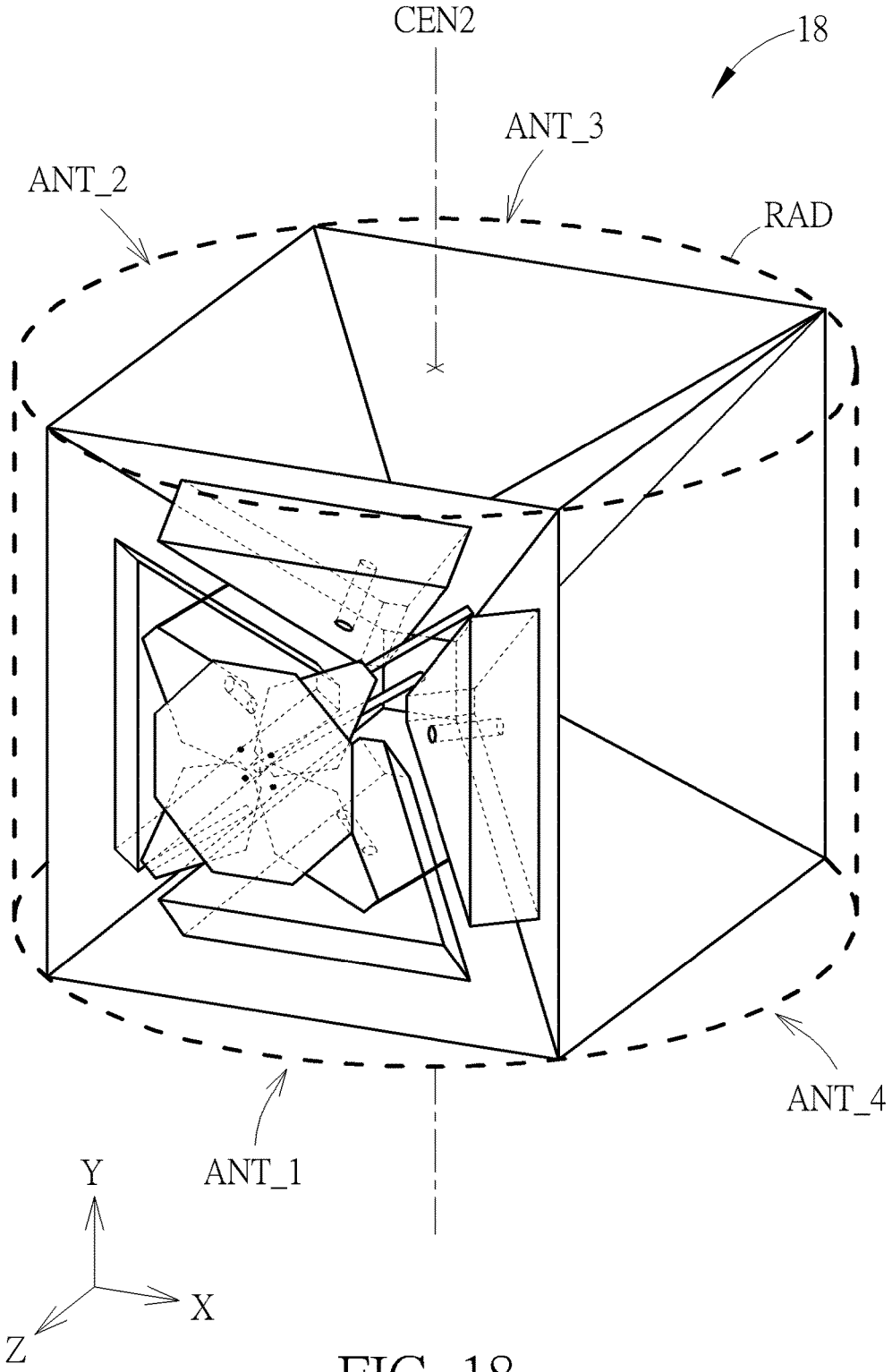
FIG. 18 is a schematic diagram illustrating a complex antenna according to an embodiment of the present invention.

On the other hand, a dual-polarized beam switching antenna set may be derived from the antenna 10, 30, 50, 70, 80 or 90 with appropriate modifications. Please refer to FIG. 18. FIG. 18 is a schematic diagram illustrating a complex antenna 18 according to an embodiment of the present invention. In FIG. 18, antennas ANT_1 to ANT_4 of identical structure constitute the complex antenna 18. The structure of any of the antennas ANT_1 to ANT_4 share the same basic concept with or based on the structure of the antenna 10 shown in FIGS. 1A, 1B, the structure of the antenna 30 shown in FIG. 3, the structure of the antenna 50 shown in FIG. 5, the structure of the antenna 70 shown in FIGS. 7A to 7C, or the structure of the antenna 80 shown in FIGS. 12A to 12B; therefore, only the antenna ANT_1 is illustrated with full details. As shown in FIG. 18, the antenna ANT_1 includes the reflective unit 700, the radiation units 320, 340, the reflective plate 560 and the supporting element 180. After combination of the antennas ANT_1 to ANT_4, the complex antenna 18 forms a symmetric annular structure on the horizontal plane (i.e., the XZ plane), and the complex antenna 18 is disposed in the cylindrical radome RAD completely. In the complex antenna 18, the peripheral reflective elements of the reflective units of the antennas ANT_1 to ANT_4 are electrically connected; namely, the antennas ANT_1 to ANT_4 share a common ground. In such a situation, it is possible to suitably adjust the reflective units of the antennas ANT_1 to ANT_4 to reduce manufacturing costs. For example, as shown in FIG. 18, the central reflective elements of the antennas ANT_2 and ANT_4 are only connected to the peripheral reflective elements of the antennas ANT_1 and ANT_3 without the peripheral reflective elements of the antennas ANT_2 and ANT_4 serving as two flanks of its central reflective element. However, the present invention is not limited thereto, and the structure of the antennas ANT_1 to ANT_4 may be slightly different from each other. During operations of the complex antenna 18, one of the antennas ANT_1 to ANT_4 may be turned on while the rest of the antennas ANT_1 to ANT_4 are turned off, such that antenna pattern characteristic simulation results of the complex antenna 18 is the same as antenna pattern characteristic simulation results of one single antenna (shown in, for example, FIGS. 10 and 11). When the antennas ANT_1 to ANT_4 are switched on in turn, antenna pattern characteristic simulation results of the antennas ANT_1 to ANT_4 overlap and are combined/superposed to form the antenna pattern characteristic simulation results of the complex antenna 18. In addition, two adjacent antennas of the antennas ANT_1 to ANT_4 may form a combined beam to improve the distribution of antenna radiation pattern, thereby making the antenna radiation pattern more homogeneous and even.

To sum up, the effective length of the radiation unit of the present invention would be lengthened with the main sections and the first arm sections, which are not coplanar to the main sections. By adjusting the ratios of the widths to the lengths of the radiation unit, the effective distance between the radiation unit and the reflective unit of the present invention would increase. The effective radiation area of the antenna of the present invention would be enlarged with the reflective plate. The conductor patches of the reflective unit in the present invention are regularly arranged to alter reflection phases of electromagnetic waves. In this way, antenna characteristics would be improved, the size of the antenna may be minimized and the transmission requirements of low frequency may be met efficiently. Besides, when the reflective unit providing magnetic conductor reflection effects matches the second arm section or the third arm section of the present invention, multiband transmission may be achieved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna for receiving and transmitting radio signals, comprising:

a reflective unit, comprising:

a central reflective element; and a plurality of peripheral reflective elements, enclosing the central reflective element to form a frustum structure; and at least one radiation unit, disposed above the central reflective element;

wherein the reflective unit is electrically isolated from the at least one radiation unit;

wherein the frustum structure has symmetry, and each of the plurality of peripheral reflective elements comprises:

a conductor base plate;

at least one conductor patch;

at least one via, wherein the at least one conductor patch is connected to the conductor base plate with the at least one via respectively to form a mushroom-type structure providing magnetic conductor reflection effects; and a spacer layer, surrounding the at least one via.

2. The antenna of claim 1, further comprising a reflective plate disposed above the at least one radiation unit, wherein a shape of the reflective plate has symmetry.

3. The antenna of claim 2, wherein a distance between the central reflective element and the reflective plate is less than one quarter of an operating wavelength.

4. The antenna of claim 2, wherein the reflective plate is a circle or a regular polygon, wherein a number of vertices of the regular polygon is a multiple of 4.

5. The antenna of claim 1, wherein the conductor base plate has a shape substantially conforming to a trapezoid, and a shape of the at least one conductor patch is similar to the shape of the conductor base plate.

6. The antenna of claim 1, wherein the at least one radiation unit comprises at least one conductor plate, and each of the at least one conductor plate comprises:

a main section; and a feed-in point, disposed on the main section.

7. The antenna of claim 6, wherein the main section of a first conductor plate of the at least one conductor plate and the main section of a second conductor plate of the at least one conductor plate form a bishop hat dipole antenna, and the first conductor plate and the second conductor plate have symmetry.

8. The antenna of claim 7, wherein each of the at least one conductor plate further comprises a first arm section, the first arm section is not coplanar to the main section, and an end of the first arm section is connected to an end of the main section.

9. The antenna of claim 8, wherein each of the at least one conductor plate further comprises a second arm section, the second arm section is not coplanar to the main section, an end of the second arm section is connected to the main section, and the end of the second arm section is separated from the end of the main section by a distance.

10. A complex antenna for receiving and transmitting radio signals, comprising a plurality of antennas, each of the plurality of antennas comprising:

a reflective unit, comprising:

a central reflective element; and a plurality of peripheral reflective elements, enclosing the central reflective element to form a frustum structure; and at least one radiation unit, disposed above the central reflective element;

wherein the reflective unit is electrically isolated from the at least one radiation unit;

wherein the frustum structure has symmetry, and each of the plurality of peripheral reflective elements comprises:

a conductor base plate;

at least one conductor patch;

at least one via, wherein the at least one conductor patch is connected to the conductor base plate with the at least one via respectively to form a mushroom-type structure providing magnetic conductor reflection effects; and a spacer layer, surrounding the at least one via.

11. The complex antenna of claim 10, each of the plurality of antennas further comprising a reflective plate disposed above the at least one radiation unit, wherein a shape of the reflective plate has symmetry.

12. The complex antenna of claim 11, wherein a distance between the central reflective element and the reflective plate is less than one quarter of an operating wavelength.

13. The complex antenna of claim 11, wherein the reflective plate is a circle or a regular polygon, wherein a number of vertices of the regular polygon is a multiple of 4.

14. The complex antenna of claim 10, wherein the conductor base plate has a shape substantially conforming to a trapezoid, and a shape of the at least one conductor patch is similar to the shape of the conductor base plate.

15. The complex antenna of claim 10, wherein the at least one radiation unit comprises at least one conductor plate, and each of the at least one conductor plate comprises:

a main section; and a feed-in point, disposed on the main section.

16. The complex antenna of claim 15, wherein the main section of a first conductor plate of the at least one conductor plate and the main section of a second conductor plate of the at least one conductor plate form a bishop hat dipole antenna, and the first conductor plate and the second conductor plate have symmetry.

17. The complex antenna of claim 16, wherein each of the at least one conductor plate further comprises a first arm section, the first arm section is not coplanar to the main section, and an end of the first arm section is connected to an end of the main section.

18. The complex antenna of claim 17, wherein each of the at least one conductor plate further comprises a second arm section, the second arm section is not coplanar to the main section, an end of the second arm section is connected to the main section, and the end of the second arm section is separated from the end of the main section by a distance.

* * * * *